US011109684B2

(12) United States Patent
Perez et al.

(10) Patent No.: US 11,109,684 B2
(45) Date of Patent: Sep. 7, 2021

(54) SEAT ASSEMBLY

(71) Applicant: Mindtra, LLC, Decatur, GA (US)

(72) Inventors: Gema Perez, Decatur, GA (US); Maureen E. Carroll, Atlanta, GA (US); Jeffrey Juskowich, Murfreesboro, TN (US); Stephen Jones, Alpharetta, GA (US)

( * ) Notice: Subject to any disclaimer, the term of this patent is extended or adjusted under 35 U.S.C. 154(b) by 73 days.

(21) Appl. No.: 16/599,913

(22) Filed: Oct. 11, 2019

(65) Prior Publication Data

US 2020/0113338 A1 Apr. 16, 2020

Related U.S. Application Data

(60) Provisional application No. 62/744,189, filed on Oct. 11, 2018.

(51) Int. Cl.

| | |
|---|---|
| ***A47C 7/62*** | (2006.01) |
| ***A47C 16/04*** | (2006.01) |
| ***A47C 7/00*** | (2006.01) |
| ***A47C 9/02*** | (2006.01) |
| ***A47C 9/00*** | (2006.01) |

(52) U.S. Cl.

CPC ..... *A47C 7/628* (2018.08); *A47C 7/002* (2013.01); *A47C 9/005* (2013.01); *A47C 9/027* (2013.01); *A47C 16/04* (2013.01)

(58) Field of Classification Search

CPC ..... A47C 7/628; A47C 7/002; A47C 7/626; A47C 7/622; A47C 9/005; A47C 9/027; A47C 16/04

USPC ..... 297/188.01, 188.08, 188.09, 188.1

See application file for complete search history.

(56) References Cited

U.S. PATENT DOCUMENTS

| | | | | |
|---|---|---|---|---|
| 2,314,080 A | | 3/1943 | Dine et al. | |
| 3,863,978 A | | 2/1975 | Gillings, Jr. | |
| 3,890,004 A | | 6/1975 | Rail | |
| 4,179,158 A | | 12/1979 | Flaum et al. | |
| 4,377,309 A | | 3/1983 | Mengshoel | |
| 4,534,590 A | | 8/1985 | Yamamura et al. | |
| 4,673,216 A | | 6/1987 | Alfer | |
| 4,883,317 A | * | 11/1989 | Davenport | A47D 1/00 297/188.1 |

(Continued)

OTHER PUBLICATIONS

Spinlife, Upeasy Seat Assist Portable Lifting Seat.

(Continued)

*Primary Examiner* — Mark R Wendell

(57) ABSTRACT

Seat assemblies are provided. In some embodiments, a seat assembly includes a seat member having a first seat surface, a second seat surface, and a third seat surface opposite the second seat surface. The third seat surface is substantially parallel to the second seat surface and the first seat surface is substantially perpendicular to both the second seat surface and the third seat surface. The seat assembly also includes a first side panel affixed to the second seat surface and a second side panel affixed to the third seat surface. Each one of those panels is substantially perpendicular to the first seat surface. The seat assembly further includes a bin movably affixed to the first side panel and the second side panel. The bin includes an open compartment and can be moved between a closed position that obstructs the compartment and an open position that permits access to the compartment.

18 Claims, 16 Drawing Sheets

(56) References Cited

U.S. PATENT DOCUMENTS

| | | | | |
|---|---|---|---|---|
| 4,987,625 | A | 1/1991 | Apparatus | |
| 5,029,350 | A | 7/1991 | Edelson | |
| 5,134,740 | A | 8/1992 | Summer | |
| 5,374,109 | A | 12/1994 | Wortman | |
| 5,490,717 | A | 2/1996 | Greene | |
| 5,642,535 | A | 7/1997 | Frawley et al. | |
| 5,732,427 | A | 3/1998 | Parnham | |
| 5,865,507 | A | 2/1999 | Earl, Jr. | |
| 5,882,081 | A | 3/1999 | Earl, Jr. | |
| 6,074,000 | A * | 6/2000 | Wagner | A47C 7/62 297/188.11 |
| 6,141,807 | A | 7/2000 | Tapper | |
| 6,578,217 | B1 | 6/2003 | Roberson | |
| 6,997,513 | B2 | 2/2006 | Ige et al. | |
| 7,086,702 | B1 | 8/2006 | Hurt | |
| 8,465,099 | B2 | 6/2013 | Addy | |
| 8,950,974 | B2 | 2/2015 | Thompson et al. | |
| 9,339,132 | B2 | 5/2016 | Burrell et al. | |
| 9,545,155 | B2 | 1/2017 | James | |
| D807,653 | S | 1/2018 | Rolzner | |
| 10,251,488 | B2 * | 4/2019 | Lan | A47C 31/00 |
| 10,625,680 | B1 * | 4/2020 | Koehler | B60R 11/00 |
| 2002/0124318 | A1 | 9/2002 | Loomos | |
| 2002/0177509 | A1 * | 11/2002 | Rodgers | A63B 23/0458 482/53 |
| 2004/0055091 | A1 | 3/2004 | Sedan | |
| 2009/0145784 | A1 * | 6/2009 | Schaff | G10G 7/005 206/216 |
| 2011/0285188 | A1 | 11/2011 | George et al. | |
| 2016/0009398 | A1 * | 1/2016 | Klettke | B60N 2/90 297/183.6 |
| 2017/0080311 | A1 * | 3/2017 | Cain | A47C 7/62 |
| 2019/0167005 | A1 * | 6/2019 | Tang | A47C 7/006 |
| 2019/0200770 | A1 * | 7/2019 | Lan | A47C 7/628 |
| 2020/0329876 | A1 * | 10/2020 | Cao | A47B 13/02 |
| 2020/0383489 | A1 * | 12/2020 | Fletcher | A47C 7/622 |

OTHER PUBLICATIONS

Little Trouble Makers, Portable Booster Seat With Storage Compartment.
Ebay, Meditation Benches.
Black Dragon Seats, The Dragon Bench.

* cited by examiner

SEAT ASSEMBLY

CROSS-REFERENCE TO RELATED APPLICATIONS

This application claims the benefit of U.S. Provisional Patent Application No. 62/744,189, filed Oct. 11, 2018, the content of which application is hereby incorporated by reference herein in its entirety.

BACKGROUND

In today's busy world, meditation is an increasing popular activity to reduce stress and promote spiritual growth. Typically, a user remains in a seated position while meditating to achieve rest and relaxation. Other activities also can reduce stress and can be conducted in a seated position, such as gardening and fishing. Yet other activities, although not stress reducers, also can be conducted in confined spaces while in a seated position. For instance, some farming activities in smaller farms can be conducted while seating on support or another type of seat assembly.

Some of the foregoing activities can rely on small tools or other gear. Yet, commonplace support assemblies do not provide a practical form of storage for those tools or gear. Even in situations in which storage is provided, the portability of such support assemblies tends to diminish.

Accordingly, much remains to be improved in the design and assembly of support assemblies that permit performing numerous activities while in a seated position.

SUMMARY

Some or all of the above needs and/or problems may be addressed by certain embodiments of the disclosure. More specifically, the disclosure recognizes and addresses, in at least some embodiments, the lack of support assemblies that are compact and easily portable while providing a storage compartment to retain tools, gear, or other types of items. As such, embodiments the disclosure provide seat assemblies that are portable and can be adjusted to have a particular height or be positioned in a particular orientation. The seat assemblies also provide storage capacity while maintaining a compact form factor. Gear, tools, or other elements also can be coupled to the seating assemblies.

As is described in greater detail below, embodiments of this disclosure include a seat assembly having a seat member that includes a bottom seat surface and two opposing lateral seat surfaces. The bottom seat surface is substantially perpendicular to the opposing lateral seat surfaces. Such lateral seat surfaces are substantially parallel to one another. The seat assembly also includes a first side panel affixed to one of the opposing lateral seat surfaces, and a second side panel affixed to the other one of the opposing lateral seat surfaces. Each one of those panels is substantially perpendicular to the bottom seat surface. The seat assembly further includes a bin movably affixed to the first side panel and the second side panel. The bin includes an open compartment and can be moved between a closed position that obstructs the compartment and an open position that permits access to the compartment. In the closed position, the seat assembly is compact and readily portable while securing items retained in the compartment.

Other embodiments, systems, methods, aspects, and features of the disclosure will become apparent to those skilled in the art from the following detailed description and the accompanying drawings.

One feature and advantage of the present disclosure is that is provides a portable seating structure that is comfortable and promotes relaxation.

Another feature and advantage of the present disclosure is to provide a seating structure that is readily portable.

Still another feature and advantage of the present disclosure is providing a portable seating structure that is adjustable in height.

Yet another feature and advantage of the present disclosure is to provide a portable seating structure that includes a storage compartment configured to store personal items, particular gear, a mobile computing device, or similar.

Still another feature and advantage of the present disclosure is providing a portable seating structure that can be placed vertically or in a tilted orientation relative to a surface that supports the seat assembly.

The above features and advantages, and other features and advantages of the disclosure are readily apparent from the following detailed description when taken in connection with the accompanying drawings.

While aspects of the disclosed seat assemblies are illustrated with reference to meditation, the disclosed seating assemblies are not so limited. Indeed, the disclosed seating assemblies can be utilized in activities such as gardening, fishing, and farming, amongst others.

Further, while the disclosed seat assemblies are illustrated in connection with specific shapes of the elements that form a seat assembly and also in connection with specific relative orientation of two or more of the elements, the seat assemblies disclosed herein are not limited to such shapes or orientations, or both. Other shapes of side panels, cushion, storage bin, seat base, and so forth can be utilized to form compact, portable seat assemblies in accordance with this disclosure. Indeed, the principles and practicable applications of the seat assemblies of the disclosure are not limited to particular morphologies of elements that form a seat assembly. Any members regardless of shape, material, coupling mechanisms, and the like can be utilized in accordance with this disclosure in order to form a seat assembly having opposing side panels attached to a seat base, and a bin movably affixed to those side panels such that the bin can be moved between a position proximate to a surface of the seat base (referred to as a "closed position") and another position distal from the seat base (referred to as "open position"). The side panels or the bin, or both, formed and arranged to provide at least two stable sitting positions having respective orientations relative to the direction of gravity or a surface onto which the seat assembly can rest.

BRIEF DESCRIPTION OF THE DRAWINGS

The detailed description is set forth with reference to the accompanying drawings, which are not necessarily drawn to scale. The use of the same reference numbers in different figures indicates similar or identical items.

DETAILED DESCRIPTION

Illustrative embodiments of the disclosure will now be described more fully hereinafter with reference to the accompanying drawings, in which some, but not all embodiments of the disclosure are shown. The disclosure may be embodied in many different forms and should not be construed as limited to the embodiments set forth herein; rather, these embodiments are provided so that this disclosure will satisfy applicable legal requirements.

Figure 1:
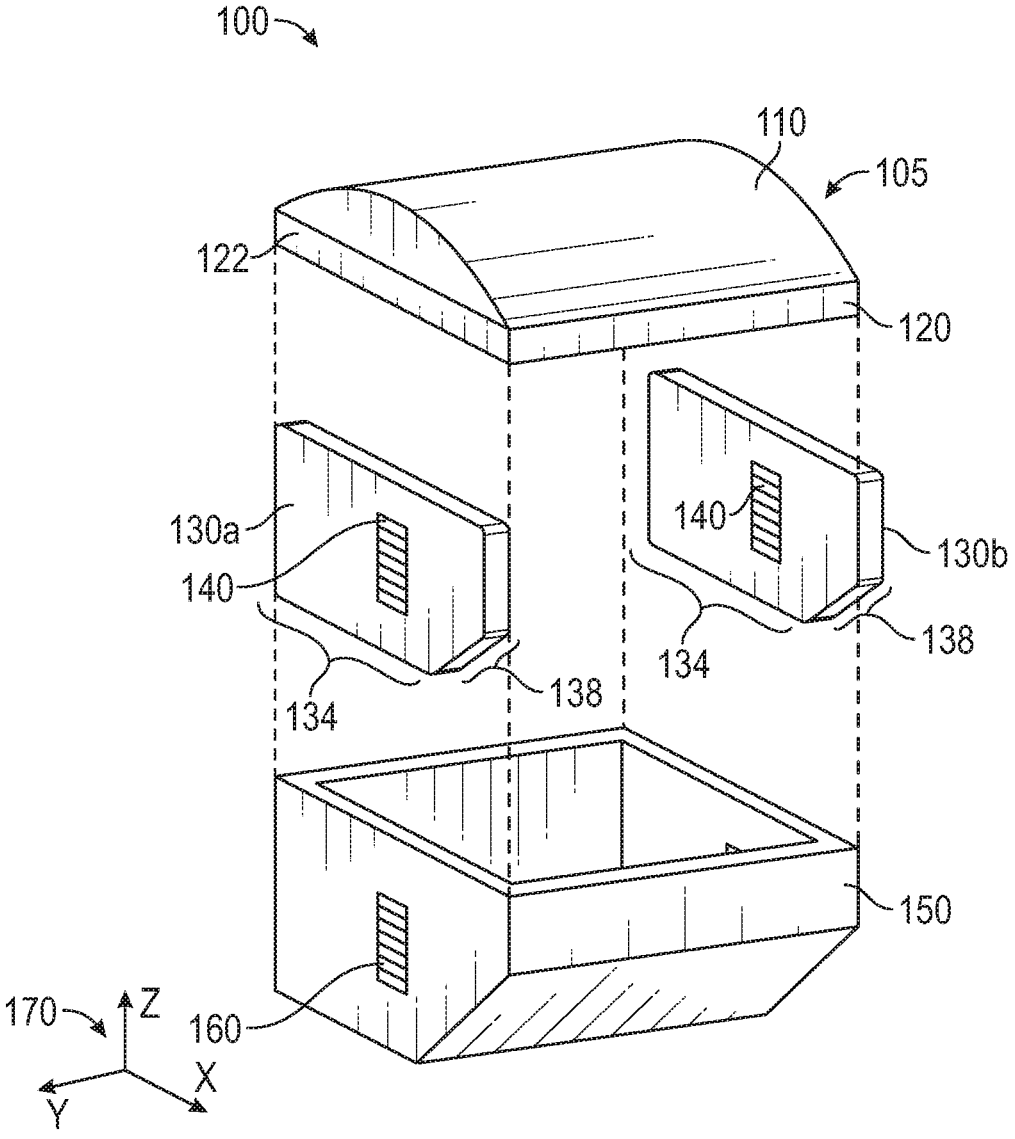
FIG. 1 illustrates an exploded view of an example of a seat assembly, according to one or more embodiments of the disclosure.

With reference to the drawings, FIG. 1 illustrates an exploded view of an example of a seat assembly 100, according to one or more embodiments of the disclosure. The seat assembly 100 includes a seat member 105 that includes a cushion 110 and a seat base 120. The seat assembly 100 also includes a first side panel 130*a* and a second side panel 130*b*. Each one of the first side panel 130*a* and the second side panel 130*b* can be affixed to respective opposing side surfaces 122 of the base member 120. It is noted that one of the side surfaces 122 is not viewable in FIG. 1. The seat assembly 100 also includes a storage bin 150 that can be movably affixed to the first side panel 130*a* and the second side panel 130*b*. To that end, each one of the first side panel 130*a* and the second side panel 130*b* includes a coupling mechanism 140. In addition, each one of opposing sidewalk of the storage bin 150 can include a coupling mechanism 160. The coupling mechanism 140 and the coupling mechanism 160 can be configured to mate and, thus, couple the storage bin 150 to each one of the first side panel 130*a* and a second side panel 130*b*. In order to mate, the coupling mechanism 140 or the coupling mechanism 160, or both, can be configured to tether one of such mechanisms to the other one of those mechanisms. More specifically, such coupling mechanism can be configured to permit coupling the storage bin 160 to the first side panels 130*a* and the second side panel 130*b* at multiple positions along a z direction in a Cartesian coordinate system 170 as is shown in FIG. 1. Accordingly, the seat assembly 100 can be reversibly configured to multiple defined heights. Thus, the coupling mechanism 140 and the coupling mechanism 160, individually or collectively, can be referred to an adjustment mechanism.

Figure 1A:
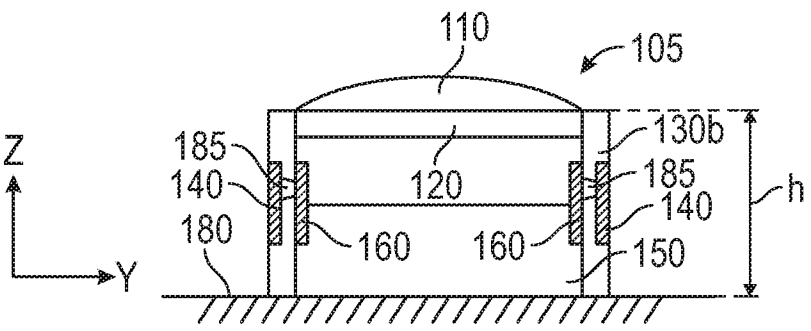
FIG. 1A illustrates a side view of an example of a seat assembly in a closed configuration, according to one or more embodiments of the disclosure.
Figure 1B:
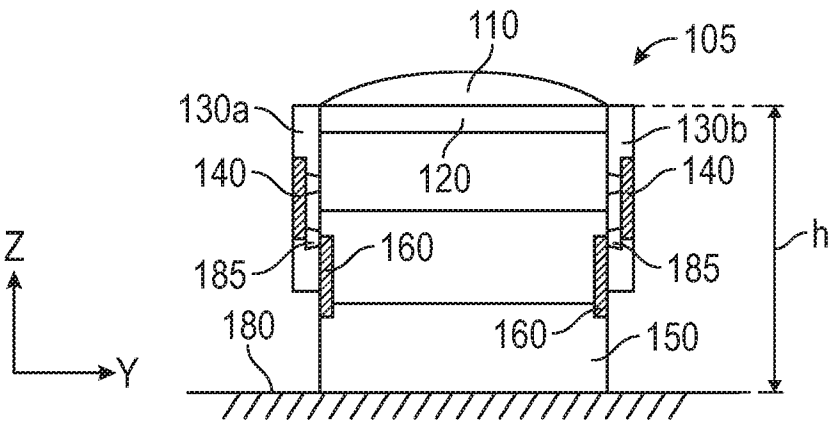
FIG. 1B illustrates a side view of the example seat assembly shown in FIG. 1A in an open configuration, according to one or more embodiments of the disclosure.
Figure 1C:
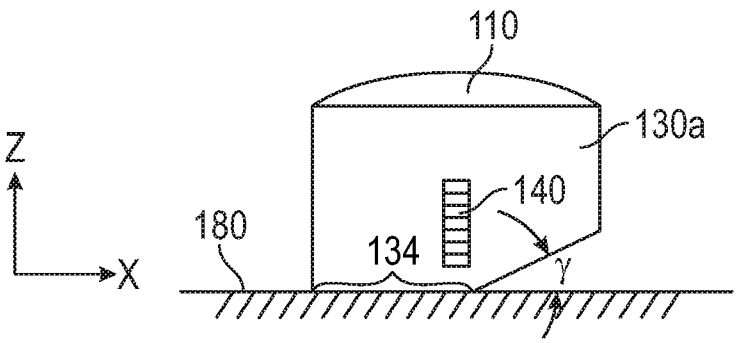
FIG. 1C illustrates a side view of the example seat assembly shown in an upright orientation, according to one or more embodiments of the disclosure.

In one instance, the storage bin 150 can be configured at a position that obstructs access to a compartment of the bin assembly 150. Such a position is referred to herein as a "closed position." In the closed position the seat assembly 100 can have a height h (a real number in units of length), as is depicted in FIG. 1A. In another instance, the storage bin 150 can configured at another position that permits access to the compartment. Such other position is referred to herein as an "open position." In the open position the seat assembly 100 can have a height H (a real number in units of length) greater than the height h, as is shown in FIG. 1B. As is illustrated in both FIG. 1A and FIG. 1B, to configure either the closed position or the open position (or any other position provided by the adjustment mechanism of the seat assembly 100), the coupling mechanism 140 can be mated with the coupling mechanism 160 by means of a tethering element 185. The relative position at which such coupling mechanisms mate determines the relative position of the side panels 130*a*, 130*b*, and the storage bin 150; thus, configuring the seat assembly at a particular height equal to h or H or intermediate between such heights.

Figure 1D:
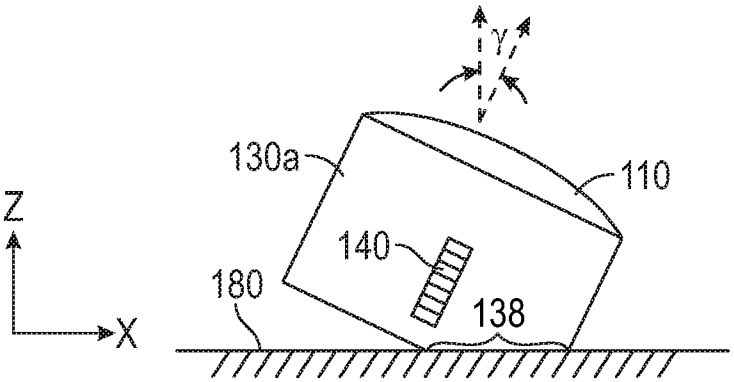
FIG. 1D illustrates a side view of the example seat assembly shown in a tilted orientation, according to one or more embodiments of the disclosure.

With further reference to FIG. 1, as is illustrated, each one of the first side panel 130*a* and the second side panel 130*b* has a first peripheral surface 134 and a second peripheral surface 138 oblique to the first peripheral surface 134, at an oblique angle γ. Similarly, the storage bin 150 has a base that includes a first surface essentially parallel to a bottom surface of the seat base 120 and a second surface oblique to the first surface, at the oblique angle γ or, in some embodiments, a different oblique angle γ'. Thus, as is shown in FIG. 1A, in a closed position, the seat assembly 100 can be oriented in an upright orientation generally parallel to the z direction (the direction of gravity, for example). In the closed position, the seat assembly 100 also can be oriented in a tilted orientation that is tilted relative to the z direction by the oblique angle γ of the peripheral surface 138, as is shown in FIG. 1D.

Figure 2A:
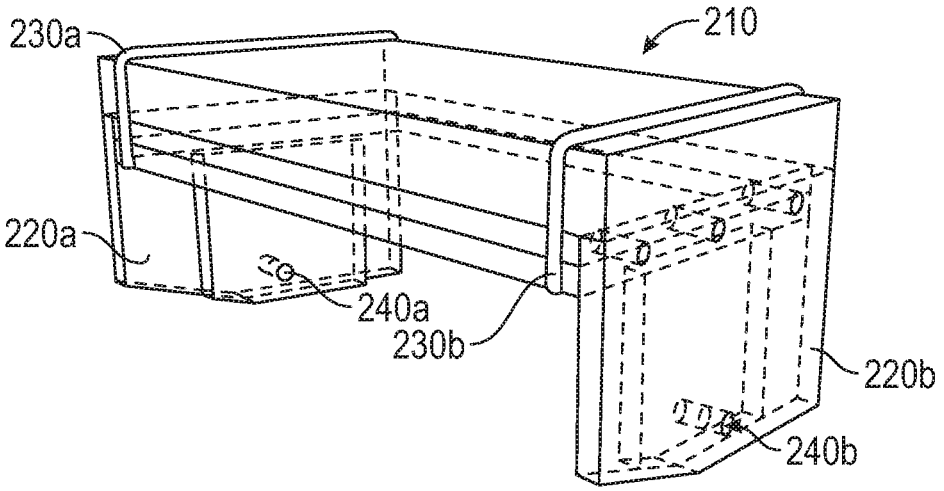
FIG. 2A illustrates a perspective view of a portion of an example of a seat assembly, according to one or more embodiments of the disclosure.

FIG. 2A illustrates a perspective view of a portion of an example of a seat assembly, according to one or more embodiments of the disclosure. The portion of such a seat assembly (e.g., seat assembly 100, FIG. 1) includes a seat member 210, a first side panel 220*a* affixed to the seat member 210, and a second side panel 220*b* affixed to the seat member 210. As is illustrated in FIG. 2A, the first panel 220*a* and the second side panel 220*b* are affixed to respective opposing surfaces of the seat assembly 210. In one embodiment, the first side panel 220*a* can be glued to a first surface of the seat assembly 210 and the second side panel 220*b* can be glued to a second surface of the seat assembly 210, where the first surface is opposite the second surface. The first side panel 220*a* has a through hole 240*a*, and the second side panel 220*b* has a through hole 240*b*.

The seat member 210 also can include a first elastic member 230*a* and a second elastic member 230*b*. The first elastic member 230*a* is placed proximate to a first end of the seat assembly 210. The second elastic member 230*a* is places proximate to a second end of the seat assembly, the second end opposite the first end. Simply as an example, the first elastic member 230*a* and the second elastic member 230*b* are embodied in respective bungee cords.

Figure 2B:
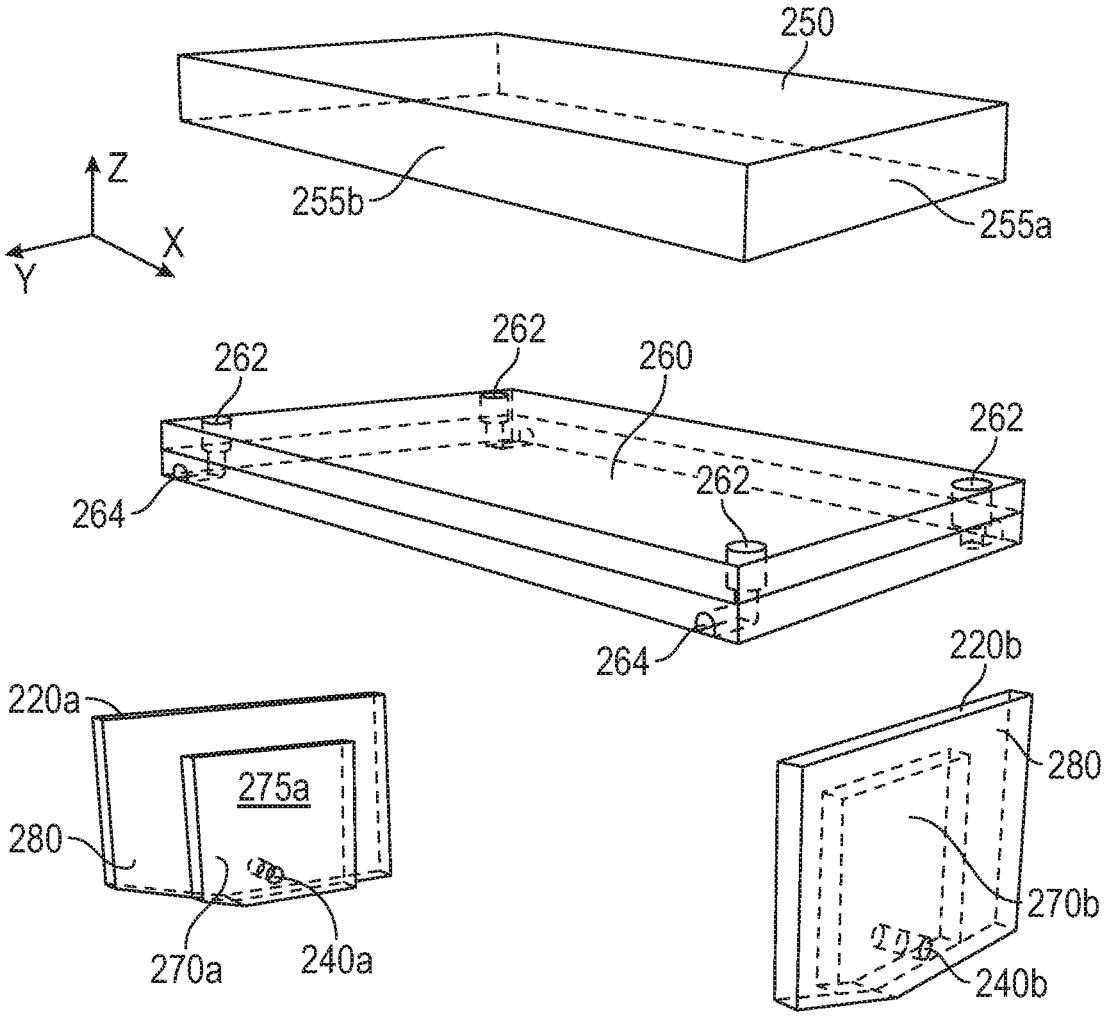
FIG. 2B illustrates an exploded view of the portion of the example seat assembly shown in FIG. 2A, according to one or more embodiments of the disclosure.

As is illustrated in FIG. 2B, the seat member 210 can include a cushion 250 and a seat base 260. The cushion 250 can include a material designed to provide comfort or absorb the weight of a user of a seat assembly including the seat member 210. The material can include foam, padding, a combination thereof, or similar. The cushion 250 has a peripheral surface that includes a first surface 255*a* and a second surface 255*b*. The peripheral surface also includes a third surface opposite the first surface 255*a*, and a fourth surface opposite the second surface 255*b*.

The seat base 260 has through holes 262 placed proximate to respective vertices of the seat base 260. The seat base 260 also has recesses 264. Each one of the recesses 264 extends longitudinally from an edge of a peripheral surface of the seat base 260 towards the interior of the seat base 260. Thus, a hole 262 and recess 264 both near a vertex of the seat base 260 can form an L-shaped cavity in the seat base 260.

As is further illustrated in FIG. 2B, the first side panel 220*a* includes a pedestal 270*a* abutting a portion of an inner surface 280 of the side panel 220*a*. A surface 275*a* of the pedestal 270*a* defines a portion of the through hole 240*a*. The second side panel also includes a pedestal 270*b* abutting a portion of an inner surface of the side panel 220*b*. A surface of the pedestal 270*b* defines a portion of the through hole 240*b*.

Figure 3:
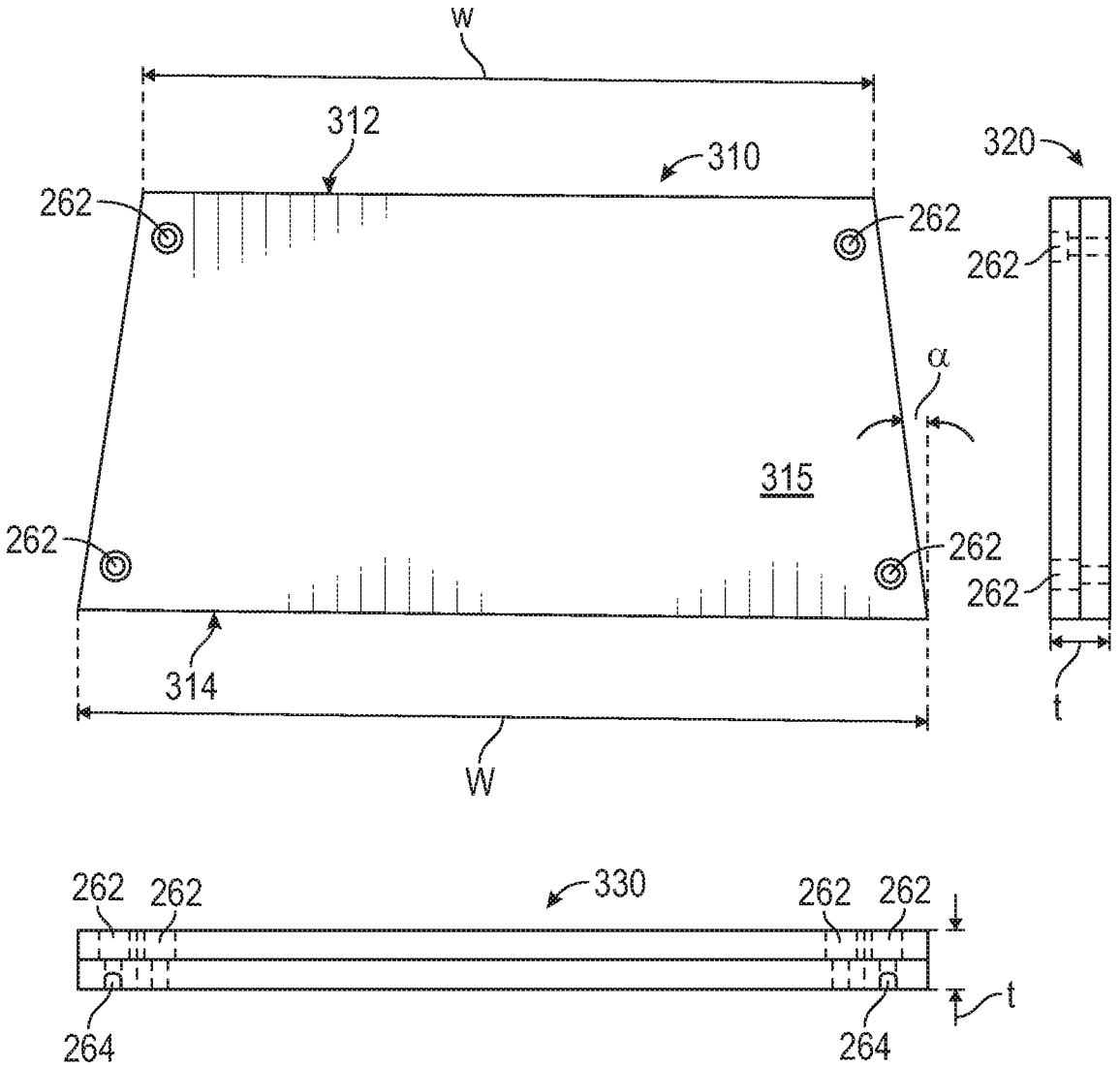
FIG. 3 illustrates various views of the example seat base shown in FIG. 2B, according to one or more embodiments of the disclosure.

FIG. 3 illustrates various side views the seat base 260 shown in FIG. 2B. A first side view 310 corresponds to a projection on an x-y plane. The first side view 310 can be referred to as a "top view," simply for the sake of nomenclature. The seat base 260 tapers from a first side 314 to a second side 312. Thus, for example, the seat member 260 has a trapezoidal cross-section 315, where the first side 314 is longer than the second side 312. Accordingly, the first side 314 has a length W (a real number in units of length) and the second side 312 has a length w (a real number in units of length), where W is greater than w. The defined length W can have a magnitude in a range from approximately 10 inches to approximately 16 inches. The defined length w can have a magnitude in a range from approximately 8 inches to approximately 15 inches. Simply as an illustration, in some configurations, w can be approximately 12 inches and W can be approximately 14 inches.

A second side view 320 corresponds to a projection on an y-z plane. The second side view 320 can be referred to as a "lateral view," simply for the sake of nomenclature. As is shown in FIG. 313, the seat base 260 can have a thickness t. (a real number in units of length). The thickness t can have a magnitude in a range from approximately 0.5 inches to about 1.5 inches. In one configuration, t is approximately 1.0 inch. A third side view 330 corresponds to a projection on an z-x plane. The third side view 330 can be referred to as a "front view," simply for the sake of nomenclature.

Figure 4A:
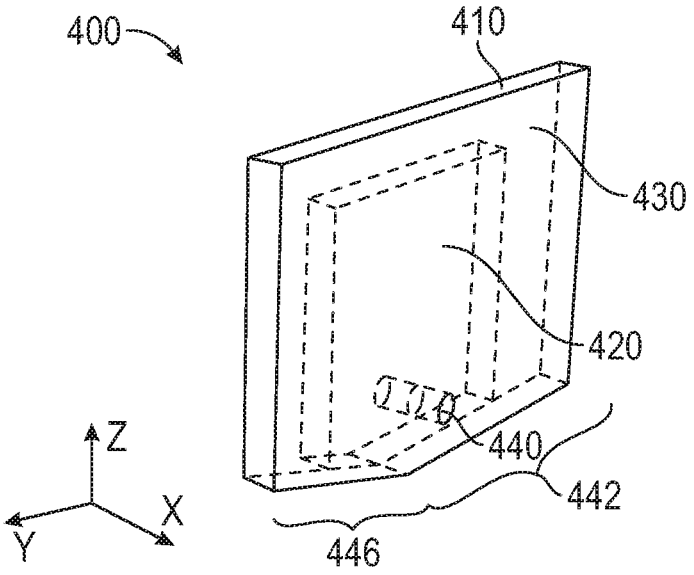
FIG. 4A illustrates a perspective view of an example of a side panel, according to one or more embodiments of the disclosure.

FIG. 4A illustrates a perspective view of an example of a side panel 400, according to one or more embodiments of the disclosure. The side panel 400 embodies each one of the first side panel 220*a* and the second side panel 220*b*. The side panel 400 includes a first panel base 410 and a pedestal 420 abutting (or otherwise forming an interface with) a first surface of the panel base 410. In a seat assembly in accordance with this disclosure, such a first surface can be referred to as an inner surface of the side panel 400. The side panel 400 has a through hole 440. A second surface 430 of the side panel 400 defines a portion of the through hole 440.

With further reference to FIG. 4A, the panel base 410 has a peripheral surface that includes a first portion 442 that can be substantially planar and is contained in the x-y plane. The peripheral surface also includes a second portion 446 that also can be substantially planar and is inclined relative to the x-y plane.

Figure 4B:
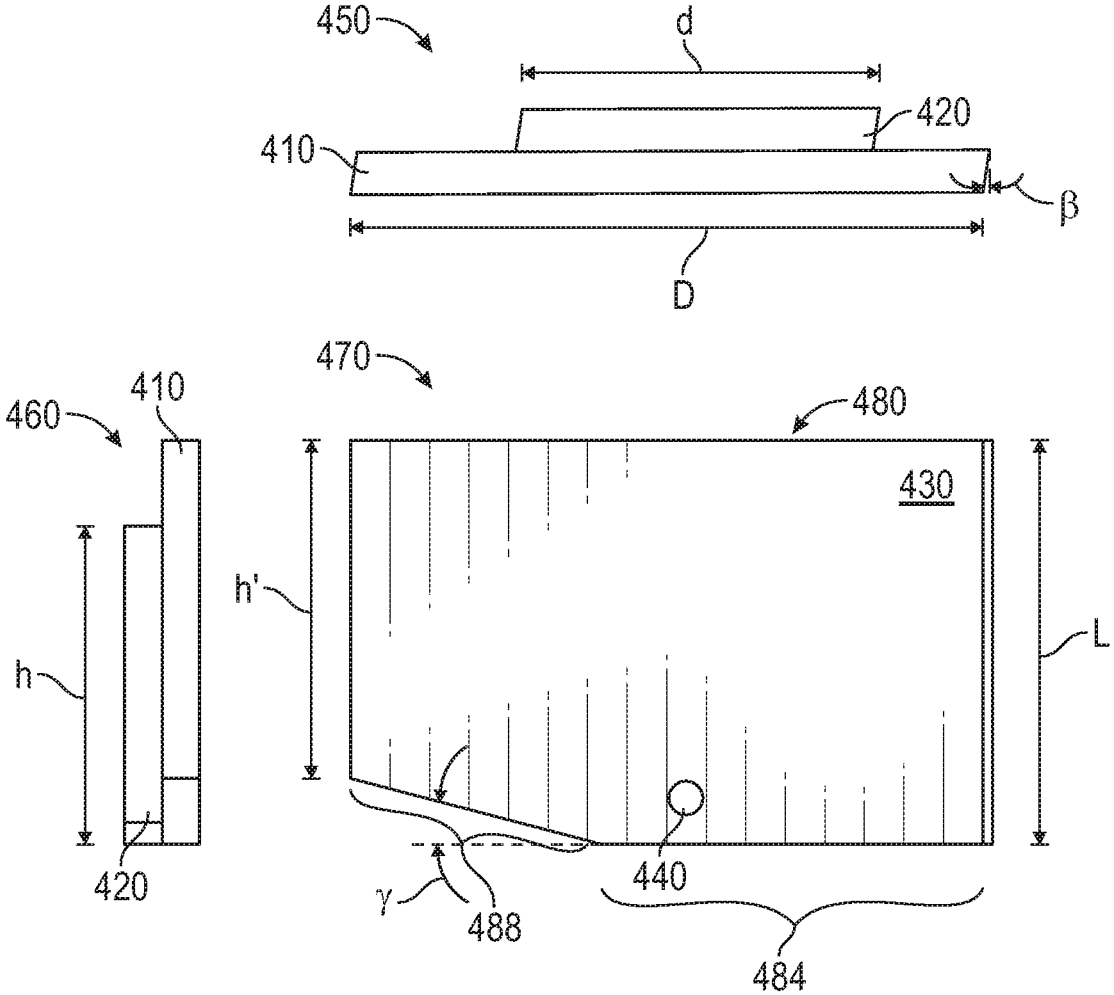
FIG. 4B illustrates various side views of the example side panel shown in FIG. 4A, according to one or more embodiments of the disclosure.

FIG. 4B illustrates various side views of the side panel 400. A first side view 450 corresponds to a projection on an x-y plane. A side of the pedestal 420 can have a length d (a real number in units of length) and a side of the panel base 410 can have a length D (a real number in units of length). In one configuration, d can be approximately 4 inches and D can be approximately 7 inches.

A second side view 460 corresponds to a projection on an x-z plane. A side of the pedestal 420 can have a length h (a real number in units of length) and a side of the panel base 410 can have a length L (a real number in units of length). In one configuration, h can be approximately 3.6 inches and L can be approximately 4.5 inches.

A third side view 460 corresponds to a projection on an y-z plane. A first side of panel base 410 can have a length h' (a real number in units of length) and a second side of the panel base 410 can have a length L (a real number in units of length). Here, L is greater than h'. In one configuration, h' can be approximately 3.75 inches and L can be approximately 4.50 inches.

As is illustrated in the third side view 470, the surface 430 has a perimeter 480. The perimeter 480 includes a first segment 484 that is substantially straight, oriented along they axis. The perimeter 480 also includes a second segment 488 that is oblique to the first segment 484. The second segment is inclined by an angle γ relative to first segment 484.

Figure 5:
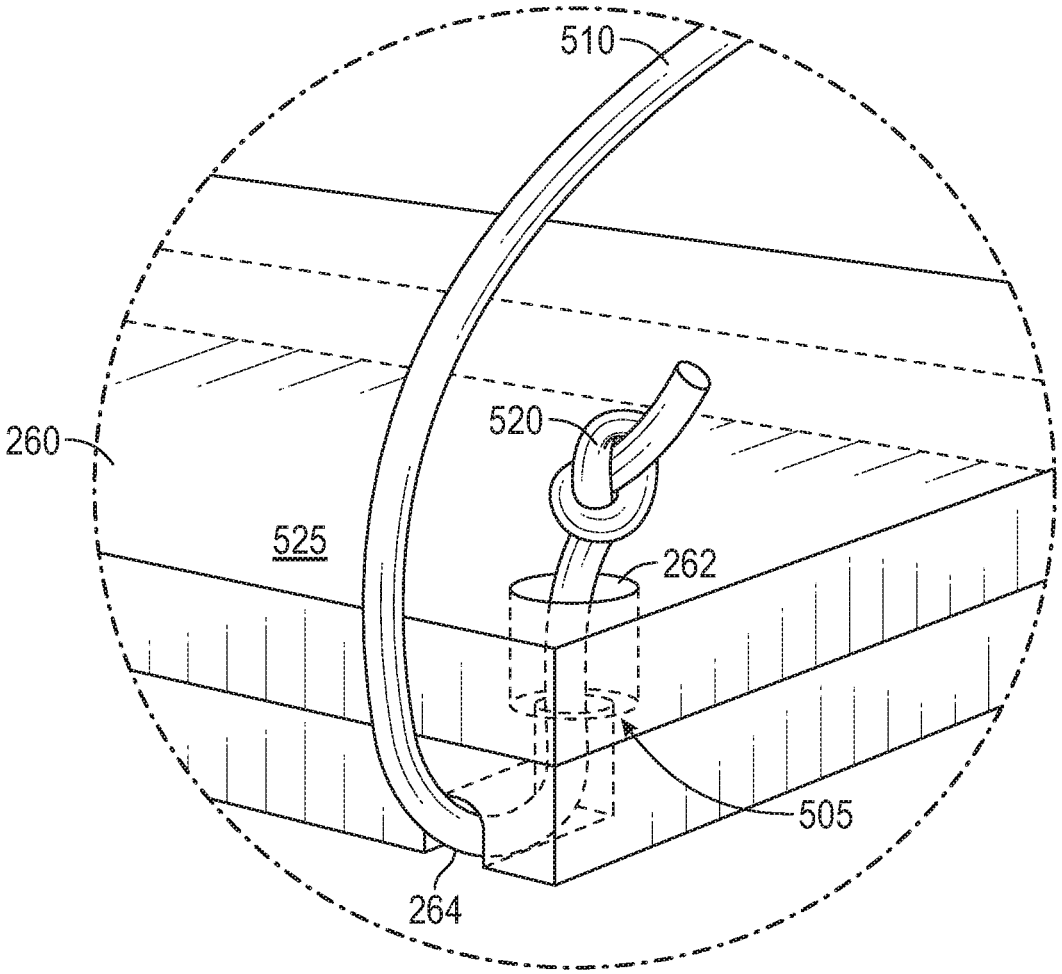
FIG. 5 illustrates an example of a cavity structure that permits coupling an elastic member to a seat base of a seat assembly, according to one or more embodiments of the disclosure.

FIG. 5 illustrates an example of a cavity structure 505 that permits coupling an elastic member 510 to the seat member 210 (FIG. 2A), according to one or more embodiments of the disclosure. The elastic member 510 can embody each one of the first elastic member 230*a* and the second elastic member 230*b*. The cavity structure 505 results from a through hole 262 and a recess 264. The elastic member 510 can be coupled by passing the elastic member 510 through the recess 264 and the hole 262, and forming a knot 520 in an end portion of the elastic member 510. The know 520 can rest on a surface 520 of the seat base 260, where the surface 525 defines a portion of the through hole 262.

Figure 6:
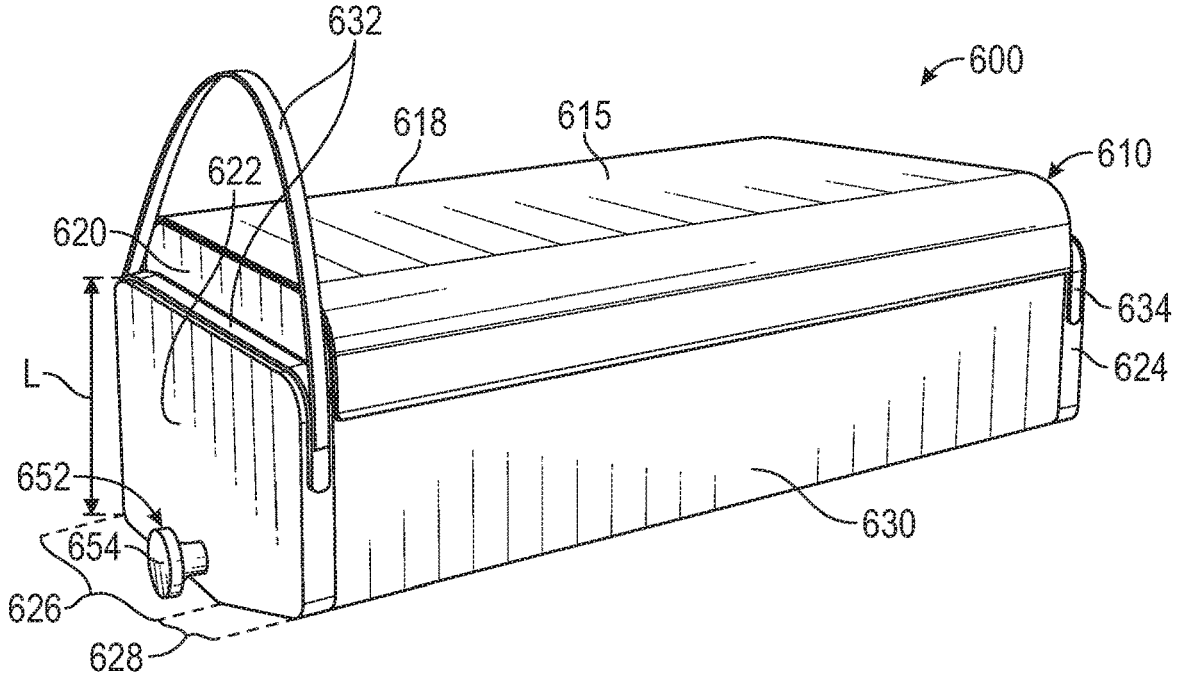
FIG. 6 illustrates a side perspective view of an example of a seat assembly, according to one or more embodiments of the disclosure.

FIG. 6 illustrates a front side perspective view of an example of a seat assembly 600, according to one or more embodiments of the disclosure. As is shown in FIG. 6, the seat assembly 600 may include an adjustable seat member 610 for a user to sit on during any sort of activity that promotes relaxation such as, for example, a meditation session. The adjustable seat member 610 may comprise a top surface 615 where the top surface 615 may include a cushion 618 disposed thereon to provide increased comfort to the user. The cushion 618 may be formed from any material designed to provide additional comfort or absorb the weight of the user, such as foam (e.g., high-density foam or medium-density foam), padding, and the like. In certain embodiments, an additional support layer 620 can be placed on top of the cushion 618 to provide extra padding when the user is sitting on the top surface 615 of the adjustable seat member 610. The additional support layer 620 may be a layer of material that provides added comfort such as, for instance, a polymetric layer, a rubber sheet, and the like. In one embodiment, the additional support layer 620 is a resilient polymetric layer. Additionally, in certain embodiments, the additional support layer 620 may be disposed on top of the cushion 618 and fastened to the underside of the adjustable seat top 610 via any sort of securing mechanism, such as, for instance, a hook, a tie, a clasp, and the like.

As is illustrated in FIG. 6, the seat assembly 600 further includes side panels 622, 624 disposed on each end of the adjustable seat member 610 that can depend therefrom. Each one of the side panels 622, 624 can have one or multiple sides having a defined length L (a real number in units of length). In some configurations, the defined length L corresponds to the height of each side panel 622, 624. The defined length L can range from approximately three inches to approximately six inches (e.g., 3.0 in, 3.5 in, 4.0 in, 4.5 in, 5.0 in, 5.5 in, or 6.0 in). Simply as an example, the defined length L can be approximately four inches. Each one of the side panels 622, 624 can be formed from a suitable rigid material, such wood, plywood, plastic, and the like.

In certain embodiments, each side panel 622, 624 may comprise a bottom surface 626 and an angled surface 628, where the angled surface 628 extends upward from the bottom surface 626, forming an oblique angle. In one embodiment, the bottom surface 626 is aligned generally parallel to the top surface 615 of the adjustable seat member 610, and the angled surface 628 is aligned oblique to both the bottom surface 626 and the top surface 615 of the adjustable seat member 610. To this end, the seat assembly 600 can rest on the bottom surface 626 of each side panel 622, 624 so that the top surface 615 of the adjustable seat member 610 is parallel to a floor. Alternatively, the seat assembly 100 can rest on the angled surface 628 of each side panel 622, 624 so that the top surface 615 of the adjustable seat member 610 is oblique to the floor.

The seat assembly 600 further comprises a storage bin 630 that is movably connected to and supported by each side panel 622, 624. In certain embodiments, the storage bin 630 may comprise an interior open compartment that permits a user to store various items, such as, for instance, foot pads or other personal items. In one embodiment, the interior compartment is movable between a closed position that is proximal to the bottom of the adjustable seat member 610 and an opened position that is distal to the bottom of the adjustable seat 610 so as to allow for easy access to items stored within the interior compartment of the storage bin 630. The storage bin 630 may be made out of any suitable material, such as wood, plywood, recycled plastic, and the like.

The seat assembly 600 may further comprise securing members 632, 634, which may be used to secure additional items to the seat assembly 600, such as, for instance, a yoga mat, a towel, and the like. The securing members 632, 634, are movably connected to side panels 622, 624, respectively. In some embodiment, the securing members 632, 634 may be retractable cords, elastic cords (such as bungee cords or elastomeric cords) or similar. The disclosure is not limited to cords and other types of securing members can be assembled in the seat assemblies disclosed herein. Simply for the sake of illustration, securing members can be embodied in elastic bands or adjustable non-elastic bands. In some embodiments, each end of the securing members 632, 634 may be threadedly disposed through a receiver hole defined in the opposing sidewalls of each side panel 622, 624.

Figure 7:
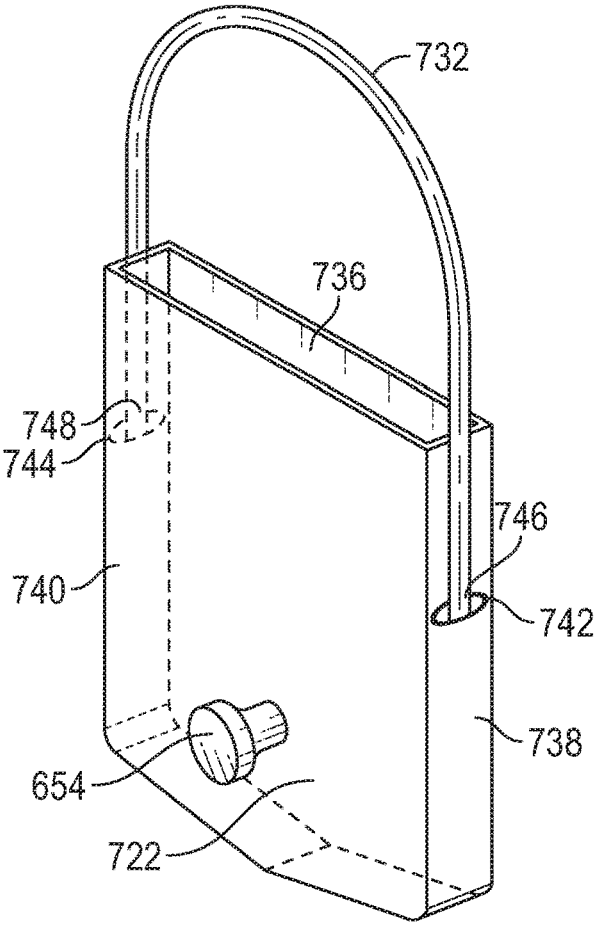
FIG. 7 illustrates a side perspective view of a side panel of the seat assembly illustrated in FIG. 6, according to one or more embodiments of the disclosure.

In addition, in certain embodiments, the top surface and/or the opposing sidewalls of each side panels 622, 624, may comprise a groove to keep the securing members 632, 634 disposed along the edge of side panels 622, 624 when not in use. For instance, FIG. 7 illustrates the side panel 622 and the securing member 632 of the seat assembly 600 as is shown in FIG. 6, where the side panel 622 comprises a top surface 136 and opposing sidewalls 138, 140. In certain embodiments, the ends of each of the securing members are threadedly disposed through two receiver holes defined in opposing sidewalls of one of the side panels 622, 624. For instance, as is shown in FIG. 7 receiver holes 742, 744 may be defined in opposing sidewalls 738, 740 of the side panel 622, respectively. The receiver holes 742, 744 are defined such that each end 746, 748 of securing member 632 is threadedly disposed through the receiver holes 742, 744, respectively. In addition, the top surface 736 of the side panel 622 may comprise a groove, such as a U-shaped groove or V-shaped groove, to keep the securing member 632 in place along the top surface 736 of the side panel 622 when not in use. It is envisioned that other means besides a groove on one or more surfaces of the side panel 622 may be used to keep securing member 632 in place when not in use.

Referring back to FIG. 6, the height of the adjustable seat member 610 may be adjusted to change the height of the seat assembly 600. To this end, the height of the adjustable seat member 610 may be lowered or raised to a desired position via an adjustment mechanism. For instance, in some embodiments, the adjustment mechanism may comprise a spring loaded knob 652 disposed on each of the side panels 622, 624. In one embodiment, the spring loaded knob 652 may comprise of a handle 654 and a pin (not depicted in FIG. 6) configured to engage with one or many openings defined by each of the sidewalls of the storage bin 630. A user can pull the spring loaded knob 652 on each of the side panels 622, 624 to raise or lower the height of the adjustable seat member 610 to a desired position. Also, the user can raise the height of the adjustable seat member 610 to access and retrieve any items stored within the storage bin 630.

Figure 8:
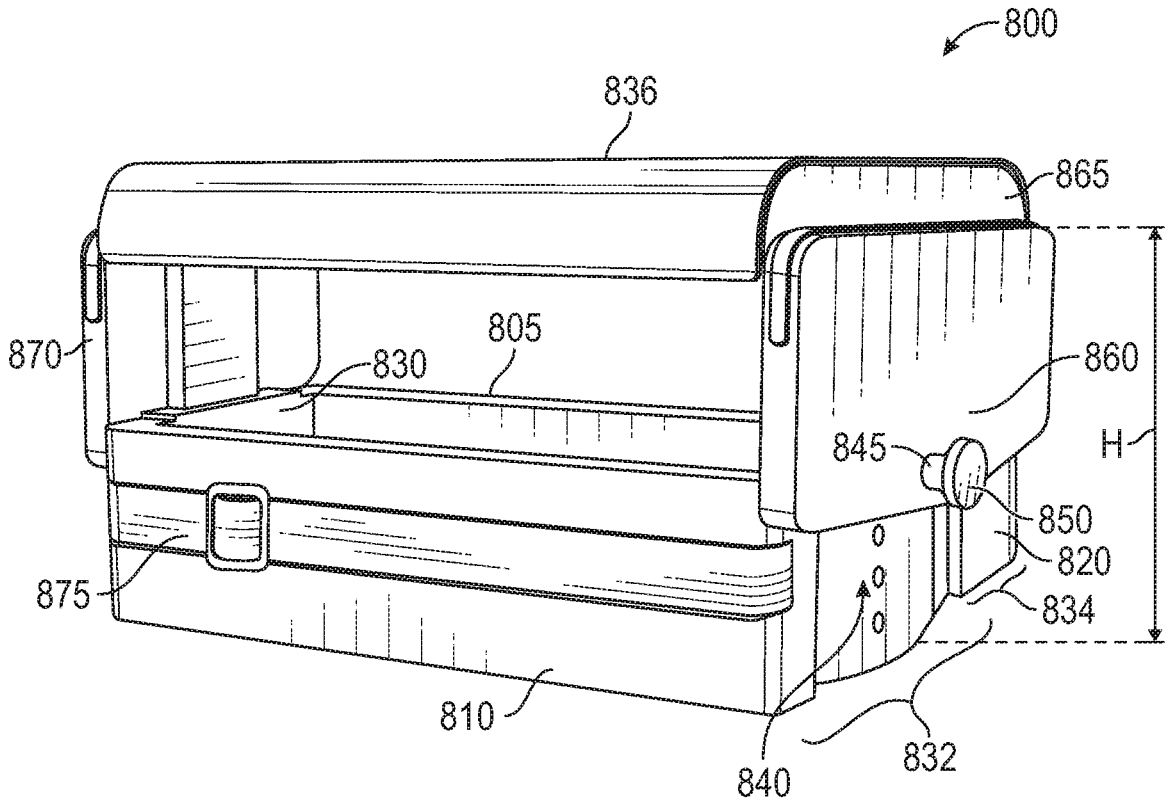
FIG. 8 illustrates another side perspective view of an example of a seat assembly in which an adjustable seat member is arranged in a raised position, according to one or more embodiments of the disclosure.

FIG. 8 illustrates another side perspective view of an example of a seat assembly 800 with the adjustable seat member in a raised position, according to an embodiment of the disclosure. As is shown in FIG. 8, the storage bin 805 of a seat assembly 800 may comprise rear wall 810 and sidewalls 820, 830. Each sidewall 820, 830 may comprise one or many openings 840 spaced at various distances along the length of each of the sidewalls 820, 830. In some embodiments, the opening(s) 840 may be configured to receive a pin 845 (shown in dashed lines in FIG. 8) of a spring loaded knob 850 disposed on each side panel 860, 870 to secure the height of the adjustable seat member 865. For instance, to raise the height of the adjustable seat member 865, each one of the spring loaded knobs 350 (one of such knobs not depicted in FIG. 8) may be pulled outward and then pull upward until reaching a desired height corresponding to a specific one of the opening(s) 840 on each of sidewalls 820, 830. Each one of the spring loaded knobs 850 may then be released to engage the pin 845 in the specific one of the opening(s) 840 in order to secure the adjustable seat member 865 at a desired distance above a floor onto which the seat assembly 800 can rest. It is envisioned that other adjustment mechanisms and related methods may be implemented to raise or lower the adjustable seat member 365.

In some embodiments, each sidewall 820, 830 of the storage bin 805 may comprise a bottom surface 832 and an angled surface 834, where the angled surface 834 extends upward from the bottom surface 832, forming an oblique angle. The bottom surface 832 is aligned substantially parallel to the top surface 836 of the adjustable seat member 865, and the angled surface 834 is aligned oblique to both the bottom surface 832 and the top surface 836 of the adjustable seat member 865. To this end, when the adjustable seat member 865 is in a raised position, the seat assembly 800 may rest on the bottom surface 832 of each sidewall 820, 830, where the top surface of the adjustable seat member 865 remains parallel to the floor onto which the seat assembly 800 can rest.

In addition, when the adjustable seat member 865 is in a raised position, the seat assembly 800 can rest on the angled surface 834 of each sidewall 820, 830 such that the seat assembly 800 is in a tilted position, where the top surface 836 of the adjustable seat 865 is oblique to the floor. In some embodiments, the bottom surface 832 and/or the angled surface 834 of sidewalls 820, 830 may correspond to the shape and/or curvature of the bottom surface and angled surface of side panels 860, 870 (also shown in FIG. 6 as bottom surface 626 and angled surface 628 of side panels 622, 624). In other embodiments, the shape and/or curvature of the angled surface 834 of sidewalls 820,830 may differ in shape and/or curvature than the angled surface of sidewalls 860, 870, such that the seat assembly 800 may be tilted at a different angle toward the floor than when the seat assembly 800 is resting on the angled surface of side panels 860, 870.

As is illustrated in FIG. 8, the seat assembly 800 may further comprise a carrying mechanism to transport the seat assembly 800 to different locations. For instance, in one embodiment, the carrying mechanism may be a strap 875 which can be utilized as a handle or shoulder strap for the user to transport the seat assembly 800 to various locations. In one embodiment, the strap 875 may be disposed along rear sidewall 810 of the storage bin 805. The strap 875 may be, for instance, an adjustable webbing strap, which a user can adjust to increase or decrease the length of the strap 875 as desired.

Figure 9:
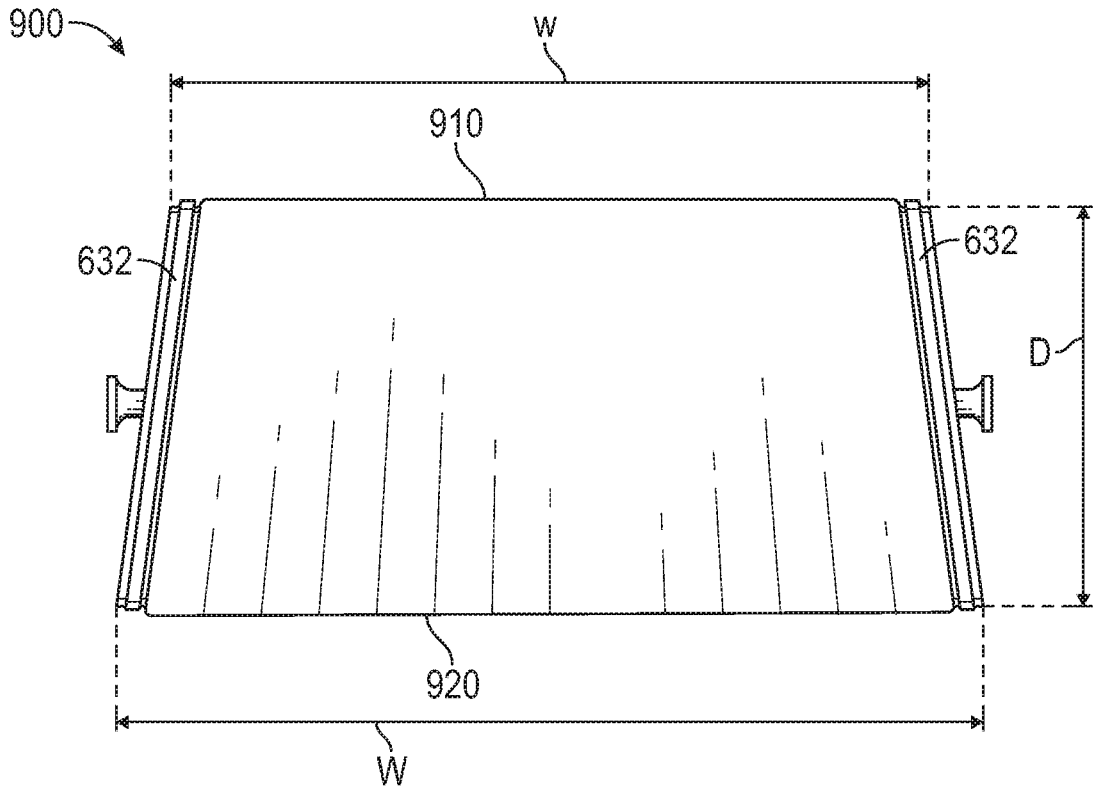
FIG. 9 illustrates a top perspective view of an example of a seat assembly, according to one or more embodiments of the disclosure.

FIG. 9 illustrates a top perspective view of an adjustable seating assembly 900, according to one or more embodiments of the disclosure. As is illustrated in FIG. 9, in some embodiments, the adjustable seat member 900 may comprise back side 910 and front side 920. In one embodiment, the front side 920 may be longer than the back side 910 such that the adjustable seating assembly 900 tapers outward (from back to front), thereby providing more space for a user's legs when the user is sitting on the adjustable seating assembly 900. Accordingly, the front side 920 can have a length W (a real number in units of length) and the back side can have a length w (a real number in units of length). The length W can have a magnitude in a range from approximately 10 inches to approximately 16 inches. The length w can have a magnitude in a range from approximately 8 inches to approximately 15 inches. Simply as an illustration, in some configurations, w can be approximately 13 inches and W can be approximately 15 inches. In other embodiments, these dimensions may be reversed, where the front side 920 may be shorter than the back side 120, such that the adjustable seat assembly 900 tapers inward (from back to front). Additionally, the adjustable seat assembly 900 can have a width D (a real number in units of length). Simply for the sake of illustrations, in some embodiments, D can be approximately seven inches. The adjustable seat assembly 900, however, can be wider or narrower.

Figure 10A:
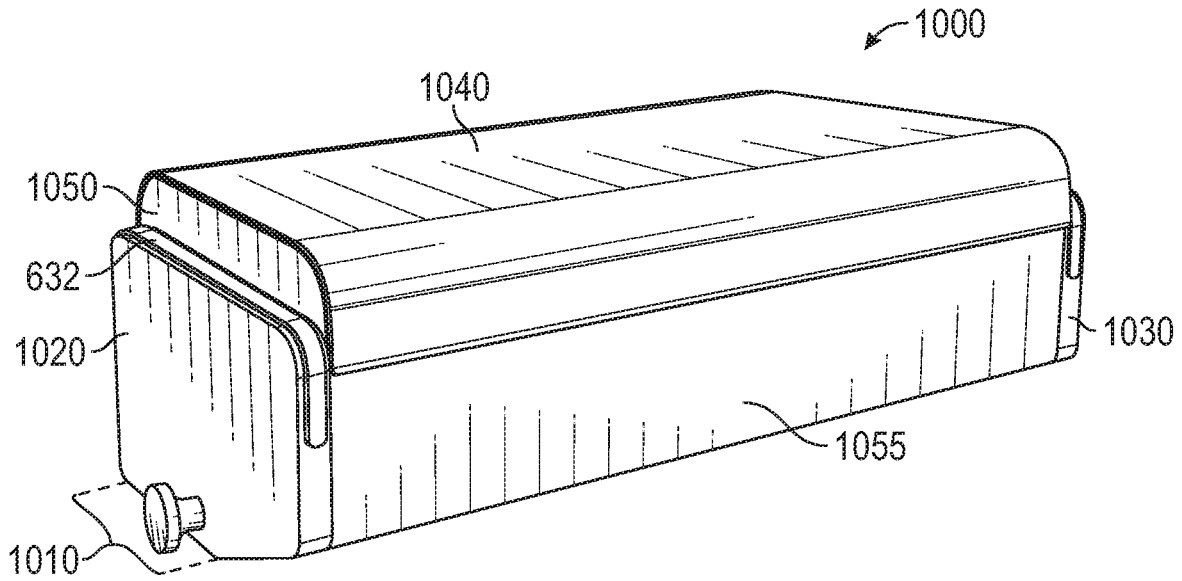
FIG. 10A illustrates a side perspective view of an example of a seat assembly in a closed position, according to one or more embodiments of the disclosure.

FIG. 10A illustrates a front perspective view of a seat assembly 1000 according to one or more embodiments of the disclosure. As discussed above with reference to FIG. 6, the seat assembly 1000 may rest on the bottom surface 1010 of each side panel 1020, 1030 to position the seat assembly 500 generally parallel to the top surface 1040 of adjustable seat member 1050, such that the seat assembly 500 is flat on a floor.

Figure 10B:
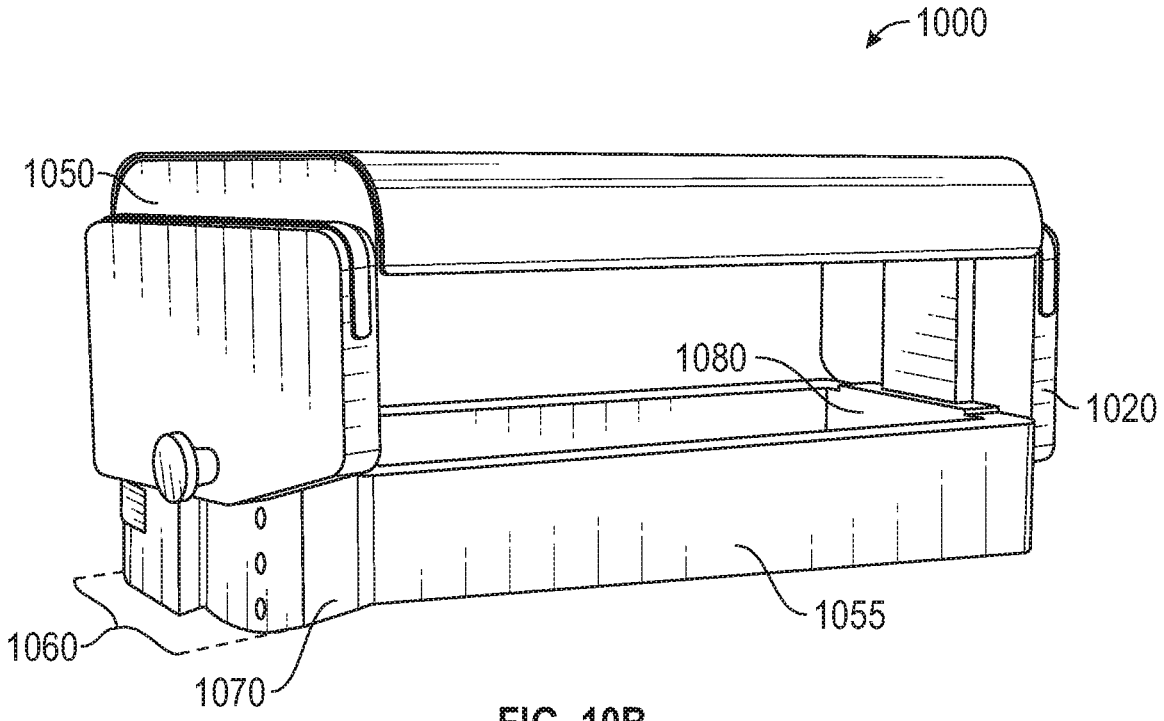
FIG. 10B illustrates a side perspective view of an example of a seat assembly in which an adjustable seat is arranged in a raised position, according to one or more embodiments of the disclosure.

FIG. 10B illustrates another front perspective view of the seat assembly 1000, where the adjustable seat member 1050 is raised in an open position, according to an embodiment of the disclosure. As is shown in FIG. 10B, the seat assembly 1000 may remain in a flat position when the height of the adjustable seat member 1050 is raised into the open position, where the seat assembly 500 rests on the bottom surface 1060 of the sidewalk 1070,1080 of the storage bin 1055.

Figure 11A:
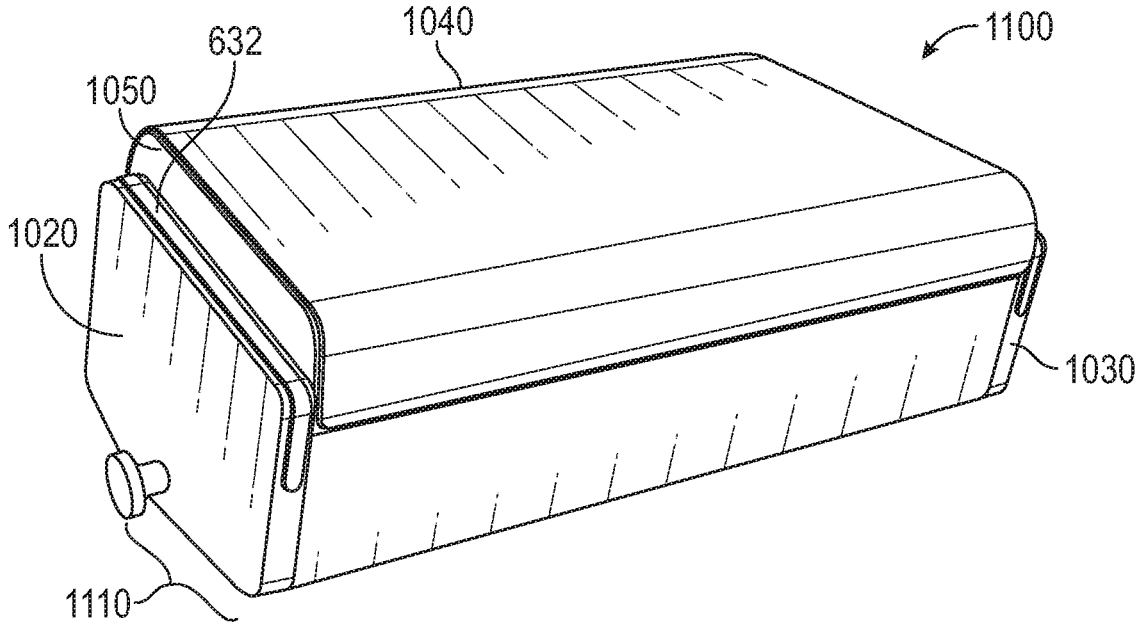
FIG. 11A illustrates a side perspective view of an example of a seat assembly arranged in a tilted orientation, according to one or more embodiments of the disclosure.

FIG. 11A illustrates another front perspective view of the seat assembly 1000 in a tilted position, according to one or more embodiments of the disclosure. As discussed above with reference to FIG. 1 and FIG. 6, the seat assembly 1000 may rest on the angled surface 1110 of each side panel 1020, 1030 to position the seat assembly 1000 oblique to the top surface 1040 of adjustable seat member 1050, such that the seat assembly 1000 is in a tilted position and angled towards a floor.

Figure 11B:
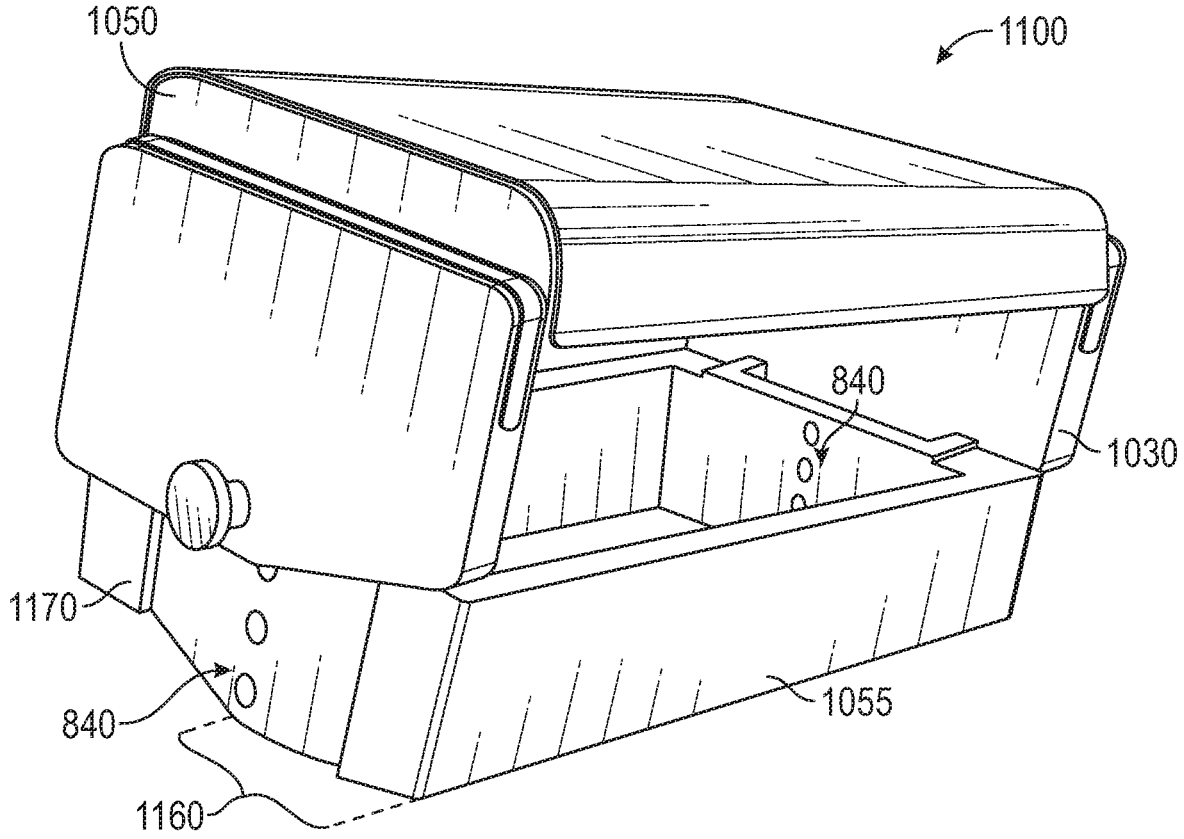
FIG. 11B illustrates a side perspective view of an example of a seat assembly arranged in a tilted position where an adjustable seat member of the seat assembly is arranged in a raised position, according to one or more embodiments of the disclosure.

FIG. 11B illustrates a front perspective view of the seat assembly 1000 in a tilted position and where the adjustable seat member 1050 is raised in an open position, according to one or more embodiments of the disclosure. As is shown in FIG. 11B, the seat assembly 1000 may remain in a tilted position when the height of the adjustable seat member 1050 is raised and in an open position, where the seat assembly 1000 rests on the angled surface 1160 of sidewalls 1170, 1180 of the storage bin 1055.

Figure 12:
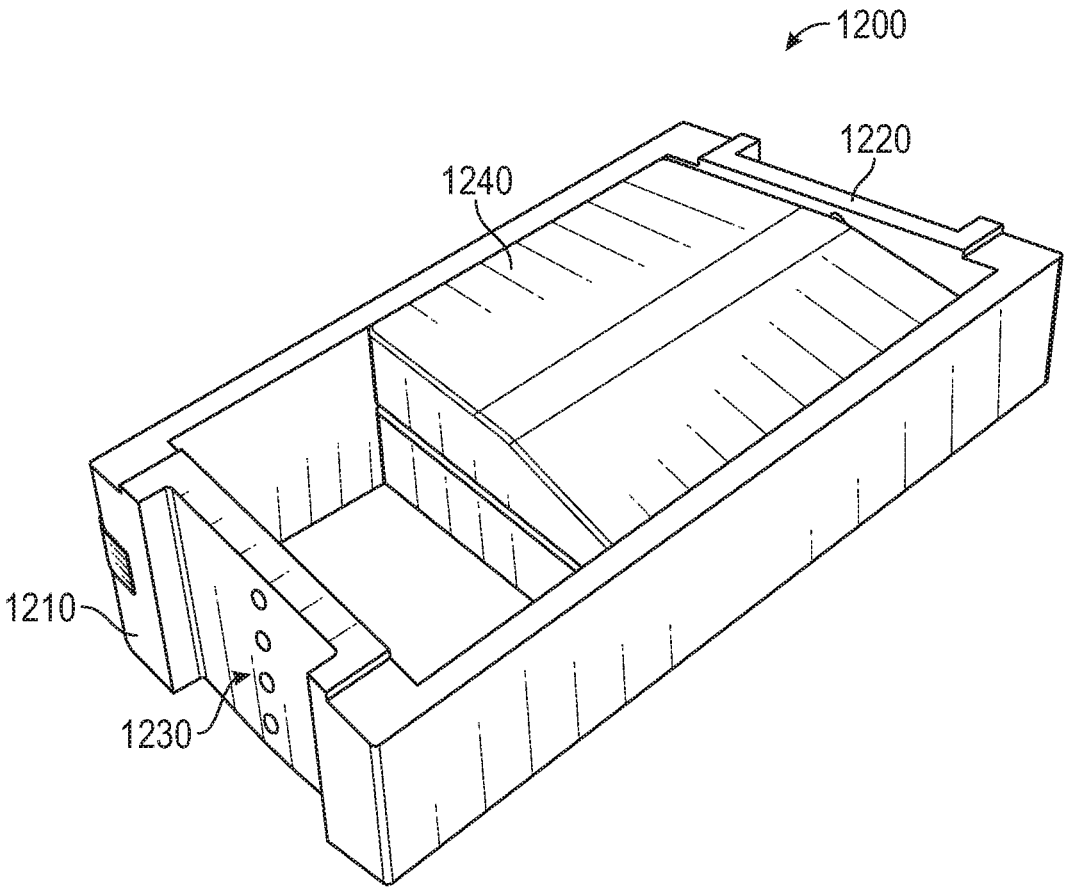
FIG. 12 illustrates a top perspective view of an example of a storage bin included in seat assembly, according to one or more embodiments of the disclosure.

FIG. 12 illustrates a top perspective view of a storage bin 1200 of a seat assembly, according to one or more embodiments of the disclosure. The storage bin 1200 can embody any of the storage bin assemblies in accordance with this disclosure. For example, the storage bin assembly 1200 can embody the storage bin 150 (FIG. 1), the storage bin 630 (FIG. 6), and the storage bin 1055 (FIG. 10A and FIG. 10B). As is shown in FIG. 12, the storage bin 1200 may include a compartment dimensioned to receive various items. The items can be retained in the storage bin 1200 while the seat assembly is in use, e.g., when a user is meditating, fishing, gardening, or similar. The items can include, for instance, one or many foot pads 1240. Simply for the sake of illustrations, a pair of foot pads 1240 are shown within the compartment. The storage bin 1200 also includes a first sidewall 1210 and a second sidewall 1220, where each one of the first sidewall 1210 and the second sidewall 1220 may comprise one or many openings 1230. The opening(s) 1230 can constitute a coupling mechanism that permits movably attaching the storage bin 1200 to a side panel (e.g., side panel 1020 or side panel 1030 (FIG. 10A)) for example. Thus, as is discussed hereinabove with reference to FIG. 6, in some embodiments, the opening(s) 1230 are dimensioned to receive a pin of a spring loaded knob or another type of adjustment mechanism. The pin that is received may secure the height of an adjustable seat member (e.g., seat member 1050) of the seat assembly to a desired position.

Figure 13A:
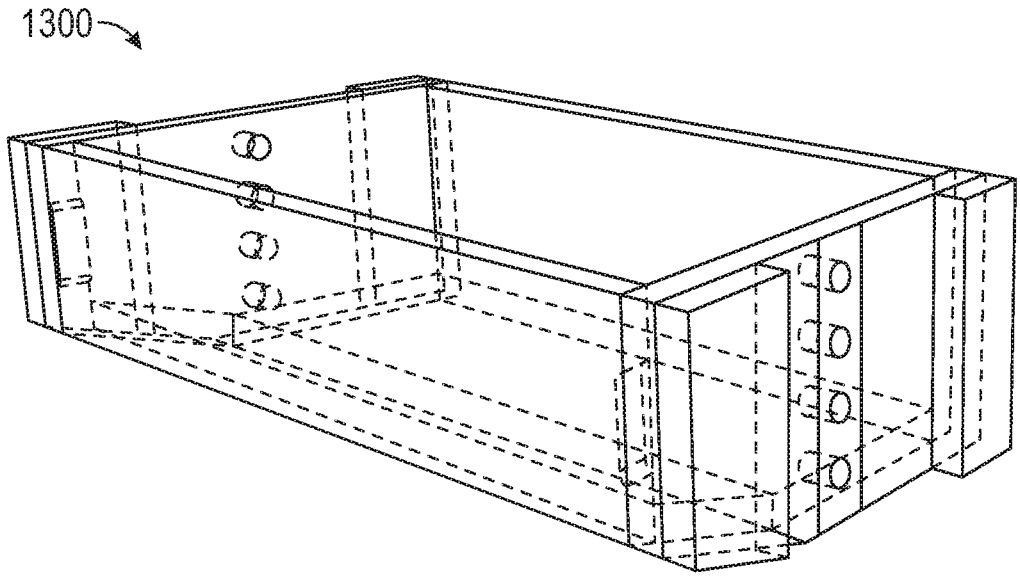
FIG. 13A illustrates a perspective view of another example of a storage bin included in a seat assembly, according to one or more embodiments of the disclosure.
Figure 13B:
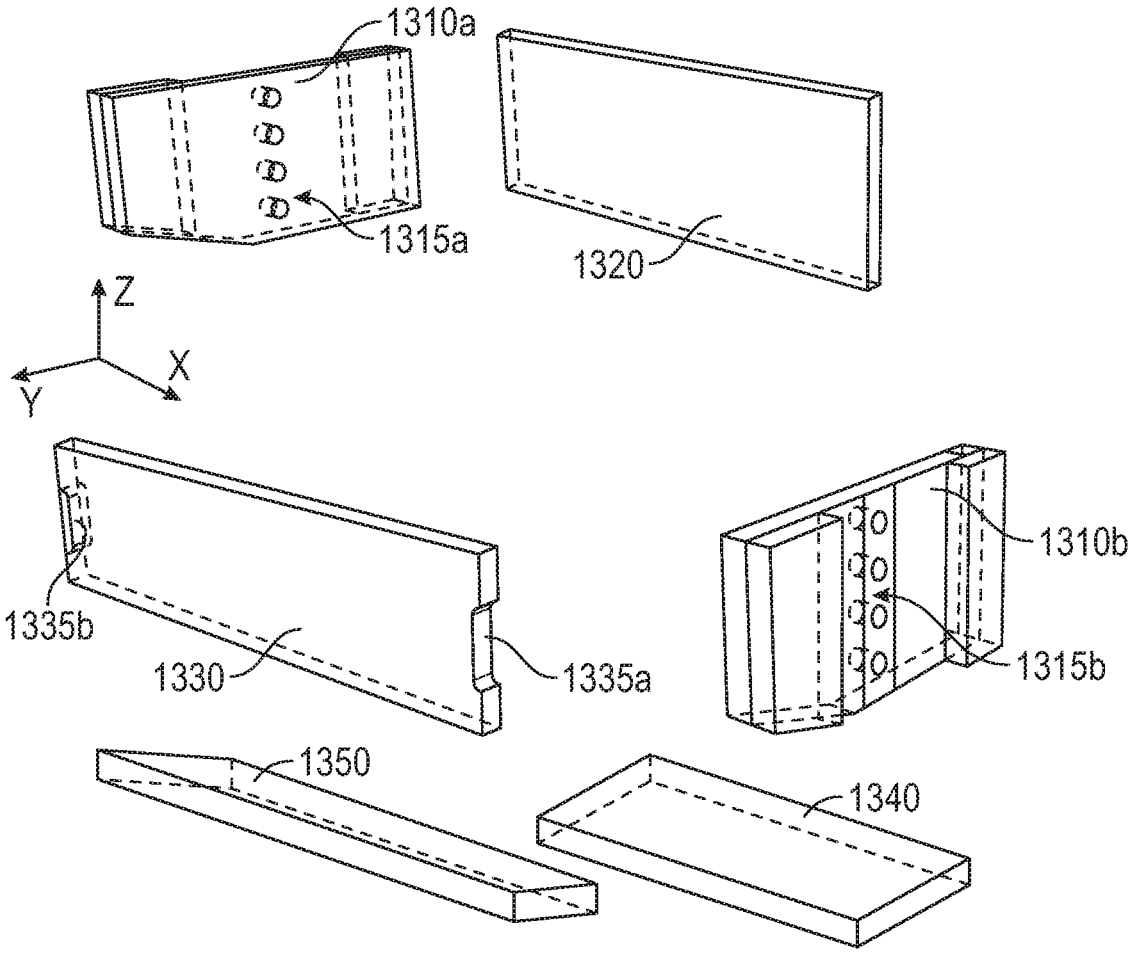
FIG. 13B illustrates an exploded view of the example storage bin shown in FIG. 13A, according to one or more embodiments of the disclosure.

FIG. 13A illustrates a perspective view of another example of a storage bin 1300, according to one or more embodiments of the disclosure. The exemplified storage bin 1300 can include four sidewalls and a non-planar bin base. More concretely, as is illustrated in FIG. 13B, the storage bin 1300 includes a first sidewall 1310*a*, a second sidewall 1310*b*, a third sidewall 1320, and a fourth sidewall 1330. The first sidewall 1310*a* has multiple through holes 1315*a* and the second sidewall 1310*b* has multiple through holes 1315*b*. The multiple through holes 1315*a* are substantially aligned along a first direction substantially parallel to a plane that contains each longitudinal axis of each through hole of the multiple through holes 1315*a*. The multiple through holes 1315*a* are substantially uniformly spaced along the first direction. The multiple through holes 1315*b* also are aligned along the first direction, and also are substantially uniformly spaced along the first direction. The first direction is essentially parallel to z direction in the Cartesian coordinate system shown in FIG. 13B.

Further, the multiple through holes 1315*a* are opposite the multiple through holes 1315*b*. Specifically, each through hole of the multiple through holes 1315*b* has a longitudinal axis that is essentially common to the longitudinal axis of a single through hole of the multiple through holes 1315*b*. In other words, the longitudinal axes of a pair of opposing through holes in the sidewalls 1310*a* and 1310*b* are substantially aligned. Such longitudinal axes are substantially parallel to the x direction in the Cartesian coordinate system shown in FIG. 13B.

The third sidewall 1320 can be a rectangular slab having a particular thickness t (a real number in units of length). The rectangular slab has minor sides and major sides. The major sides can have a length T (a real number in units of length). The fourth sidewall 1330 is opposite the third sidewall 1320 and also can have the thickness t. The fourth sidewall 1330 includes a first recess 1335*a* and an opposing second recess 1335*b*. Such recesses can permit assembling a carrying mechanism in the storage bin 1300. The carrying mechanism can be, for example, a strap, a semi-rigid handle, a rigid handle, or similar.

The non-planar bin base can be formed, for example, from a first base member 1340 and a second base member 1350 in order to provide two orientations of a seat assembly that includes the storage bin 1300, for example. Thus, the first base member 1340 and the second base member 1350 form an oblique angle.

Figure 14:
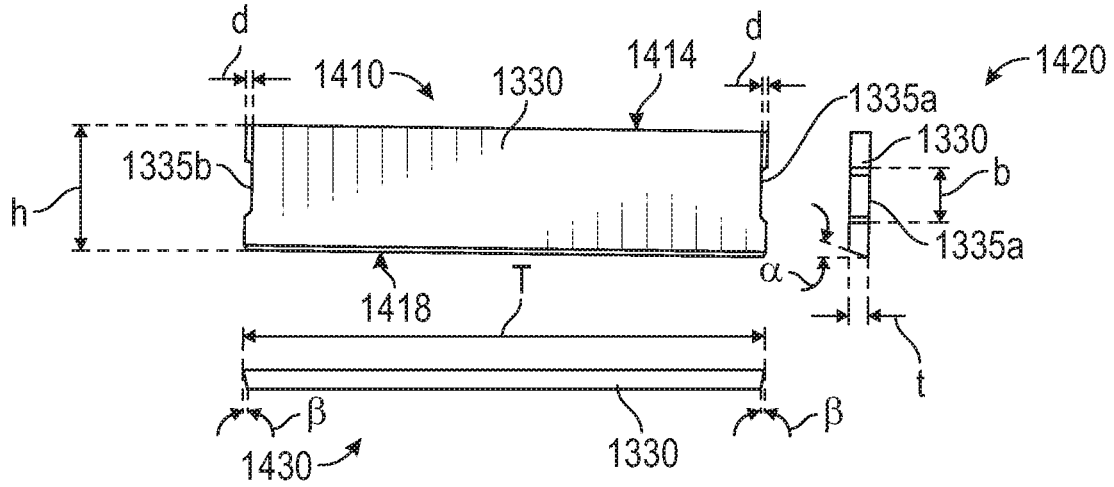
FIG. 14 illustrates side views of a sidewall of the example storage bin shown in FIG. 13A, according to one or more embodiments of the disclosure.

FIG. 14 illustrates side views of the fourth sidewall 1330 (FIG. 13B), according to one or more embodiments of the disclosure. A first side view 1410 corresponds to a projection on an x-z plane. Each one of the sides of the sidewall 1330 that includes the recesses 1335*a* and 1335*b* has a length h (a real number in units of length). In turn, each one of the first recess 1335*a* and the second recess 1335*b* has a depth d (a real number in units of length). In one configuration, h can be approximately 3 inches and d can be approximately 0.15 inches.

The sidewall 1330 has a top side 1414 and a bottom side 1418 opposite the top side 1414. The bottom side 1418 is oblique relative to the top side 1414. The oblique angle is labeled a and can have a magnitude of approximately 15 degrees.

A second side view 1420 corresponds to a projection on an y-z plane. The first recess 1335*a* has a length h (a real number in units of length). The second recess 1335*b* (not depicted in side view 1420) also has a length b. In one configuration, h can be approximately 1.25 inches and t can be approximately 0.50 inches.

A third side view 1430 corresponds to a projection on an x-y plane. The section of the sidewall 1330 that is shown has a first side 1434 that tapers to a second side 1438 according to an oblique angle β. In one configuration, the oblique angle β has a magnitude of approximately 8 degrees.

Figure 15:
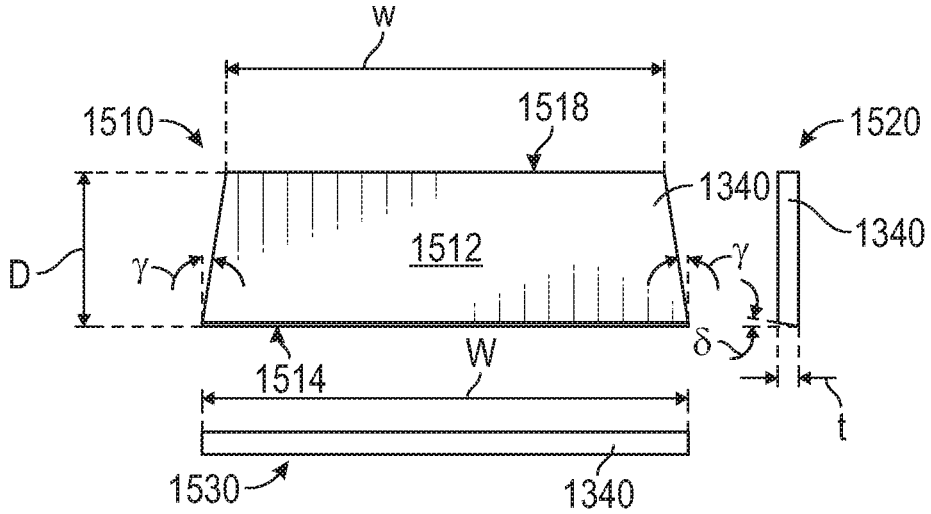
FIG. 15 illustrates side views of another sidewall of the example storage bin shown in FIG. 13A, according to one or more embodiments of the disclosure.

FIG. 15 illustrates side views of the base member 1340 (FIG. 13B), according to one or more embodiments of the disclosure. First side view corresponds to a projection on an x-y plane. The base member 1340 tapers from a first side 1514 to a second side 1518 according to an angle γ. Thus, for example, the base member 1340 has a trapezoidal cross-section 1512, where the first side 1514 is longer than the second side 1518. Accordingly, the first side 1514 has a length W and the second side 1518 has a length w, where W is greater than w. The length Wean have a magnitude in a range from approximately 10 inches to approximately 12 inches. The length w can have a magnitude in a range from approximately 9 inches to approximately 11 inches. Simply as an illustration, in some configurations, w can be approximately 10 inches and W can be approximately 11 inches.

The height of the trapezoidal cross-section 1512 is D (a real number in units of length). In one configuration, the magnitude of D can be approximately 3.60 inches.

A second side view 1520 corresponds to a projection on an y-z plane. The base member 1340 has a thickness t (e.g., approximately 0.5 inches). A first side is oblique to a second side opposite the first side. The oblique angle is labeled δ. In one configuration, δ can have a magnitude of approximately 8 degrees.

A third side view 1530 corresponds to a projection on a z-x plane. The section of the base member 1340 that is shown is essentially rectangular, having a base side of length W, as is discussed above.

Figure 16:
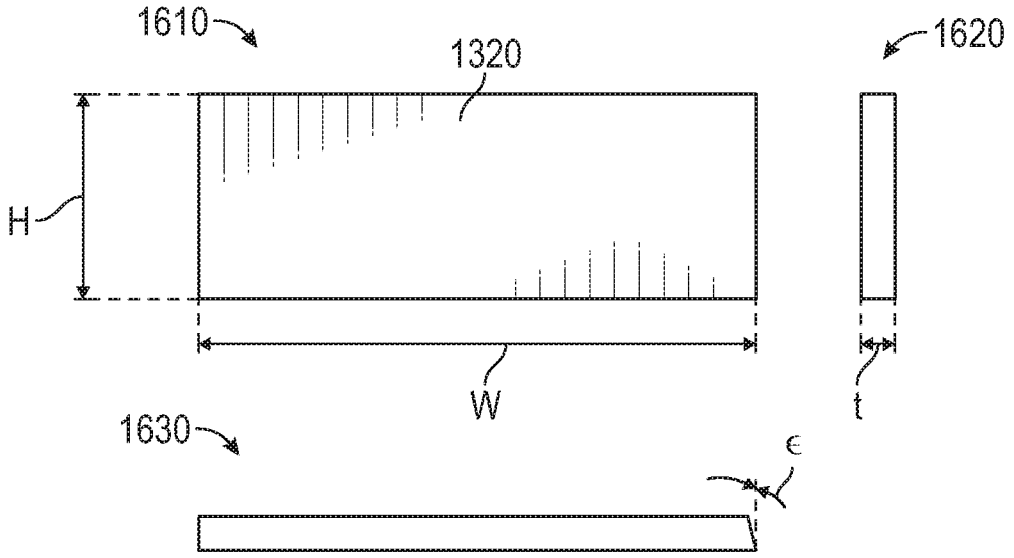
FIG. 16 illustrates side views of another sidewall of the example storage bin shown in FIG. 13A, according to one or more embodiments of the disclosure.

FIG. 16 illustrates side views of the sidewall 1320 (FIG. 13B), according to one or more embodiments of the disclosure. As mentioned, the sidewall 1320 is essentially a slab having rectangular section and thickness t. Side views 1610, 1620, and 1630 corresponds to projections on an z-x plane, a z-y plane, and a x-y plane, respectively. The section shown in the side view 1630 has a first side that is oblique to a second side opposite the first side. The oblique angle is labeled ε. In one configuration, ε can have a magnitude of approximately 8 degrees.

Figure 17:
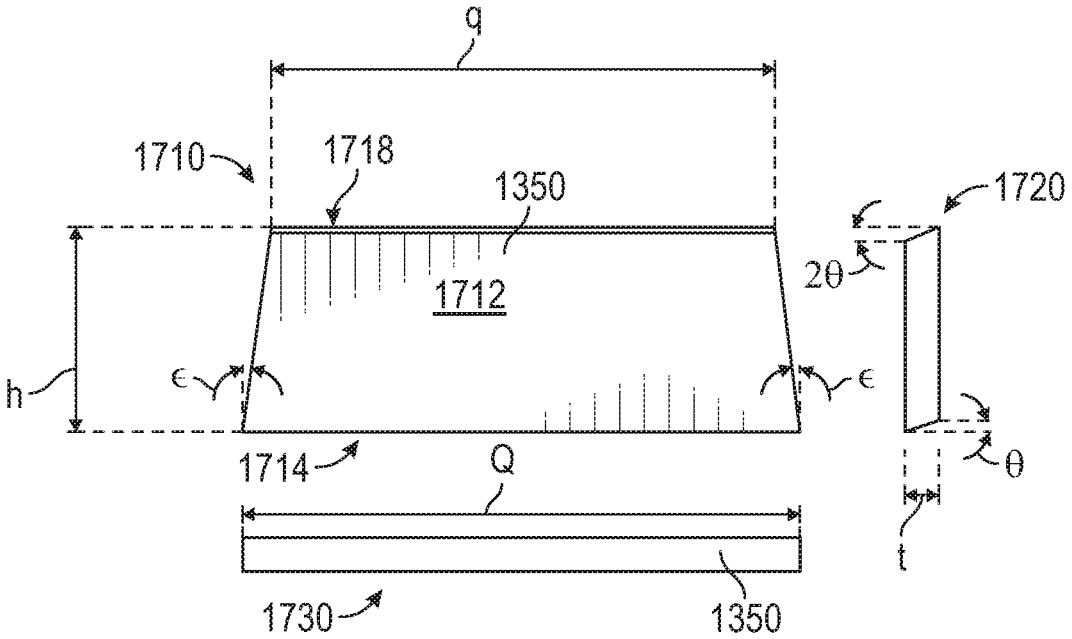
FIG. 17 illustrates side views of another sidewall of the example storage bin shown in FIG. 13A, according to one or more embodiments of the disclosure.

FIG. 17 illustrates side views of the base member 1350 (FIG. 13B), according to one or more embodiments of the disclosure. First side view 1710 corresponds to a projection on an x-y plane. The base member 1350 tapers from a first side 1714 to a second side 1718 according to an angle θ. Thus, for example, the base member 1350 has an essentially trapezoidal cross-section 1712, where the first side 1714 is longer than the second side 1718. Accordingly, the first side 1714 has a length Q and the second side 1718 has a length q, where Q is greater than q. The length Q can have a magnitude in a range from approximately 10 inches to approximately 12 inches. The length w can have a magnitude in a range from approximately 9 inches to approximately 11 inches. Simply as an illustration, in some configurations, q can be approximately 10 inches and Q can be approximately 11 inches.

The height of the trapezoidal cross-section 1512 is h (a real number in units of length). In one configuration, the magnitude of h can be approximately 2.50 inches.

A second side view 1520 corresponds to a projection on an y-z plane. The base member 1350 has a thickness t (e.g., approximately 0.5 inches). A first side is oblique having an inclination angle θ. A second side opposite the first side also is oblique and has an inclination angle 2θ, to a second side opposite the first side. The oblique angle can have a magnitude of approximately 8 degrees, for example.

A third side view 1730 corresponds to a projection on a z-v plane. The section of the base member 1350 that is shown is essentially rectangular, having a base side of length Q, as is discussed above.

Figure 18A:
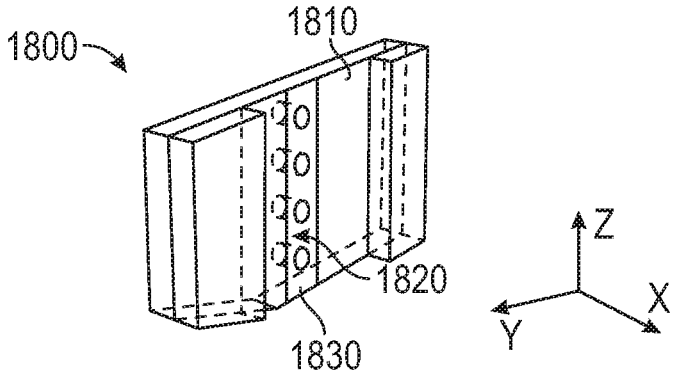
FIG. 18A illustrates a perspective view of a yet another sidewall of the example storage bin shown in FIG. 13A, according to one or more embodiments of the disclosure.

FIG. 18A illustrates a perspective view of a sidewall 1800 that can be integrated into a storage bin in accordance with aspects of this disclosure. The sidewall 1800 can embody each one of the first sidewall 1310*a* (FIG. 13B) and the second sidewall 1310*b* (FIG. 13B). The sidewall 1800 includes a recess 1810 and multiple through holes 1820. The multiple through holes 1820 embody the multiple through holes 1315*a* and also embody the multiple through holes 1315*a*. A bottom surface of the recess 1810 defines at least a portion of the multiple through holes 1820. The bottom surface also can define a second recess configured to receive a plate 1830. The plate 1830 also has through holes aligned with respective ones of the multiple through holes 1820. The plate 1830 can be formed from steel or another rigid material and reinforces the multiple through holes 1820.

Figure 18B:
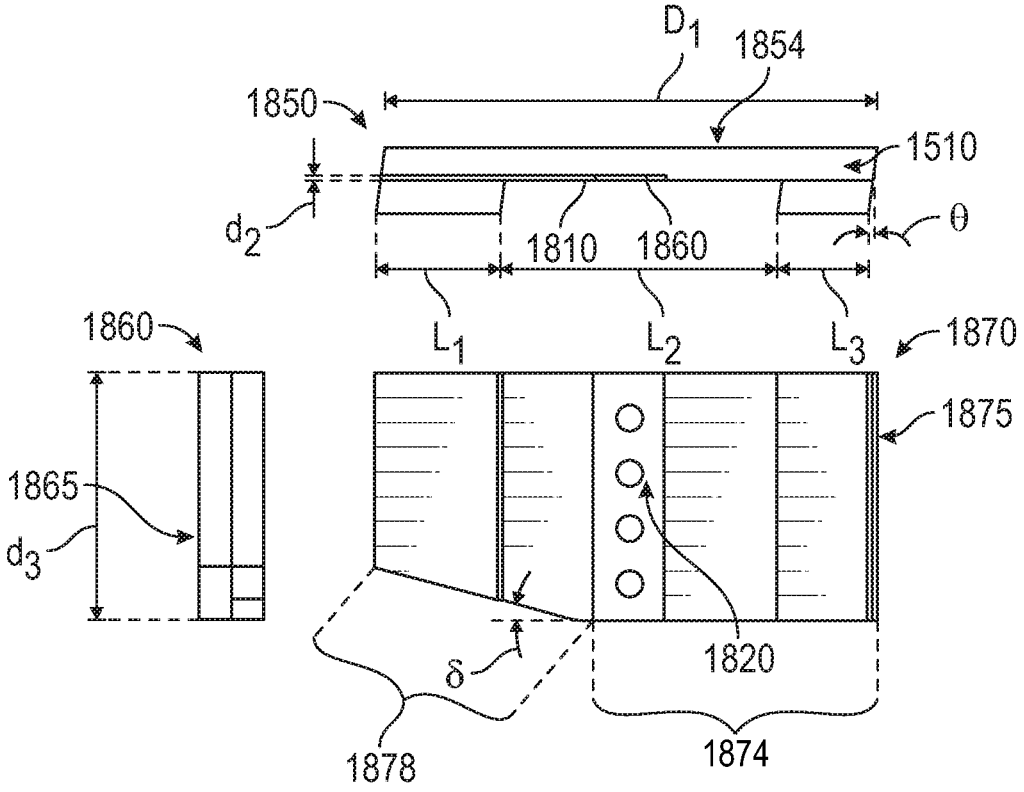
FIG. 18B illustrates various side views of the example sidewall shown in FIG. 18A, according to one or more embodiments of the disclosure.

FIG. 18B illustrates various side views of the example sidewall 1800 shown in FIG. 18A. A first side view 1850 corresponds to a projection on an x-y plane and can be referred to as a "top view." As is illustrated, the sidewall 1800 has oblique sides, with an oblique angle θ. The sidewall 1800 has a major side 1854 that has a length $d_1$ (a real number in units of length). Top surfaces of the recess 1810 have respective sides 1858, each having a length $L_1$ (a real number in units of length). The bottom surface of the recess 1810 has a transversal side of length $L_2$. As mentioned, the bottom surface of the recess 1810 defines a second recess having a depth $d_2$ (a real number in units of length).

A second side view 1860 corresponds to a projection on an x-z plane and can be referred to as a "lateral view." A side 1865 of the sidewall 1800 has a length a (a real number in units of length).

A third view 1870 corresponds to a projection on a y-z plane and can be referred to as a "backside view" because the shown side of the sidewall 1800 faces the interior of the storage bin 1300 when forming part of a seat assembly in accordance with this disclosure. The projection of the sidewall 1800 shown in the third view has a perimeter 1815. The perimeter 1875 includes a first segment 1874 that is substantially straight, oriented along they axis. The perimeter 1875 also includes a second segment 1878 that is oblique to the first segment 1874. The second segment is inclined by an angle γ relative to first segment 1874.

Figure 19A:
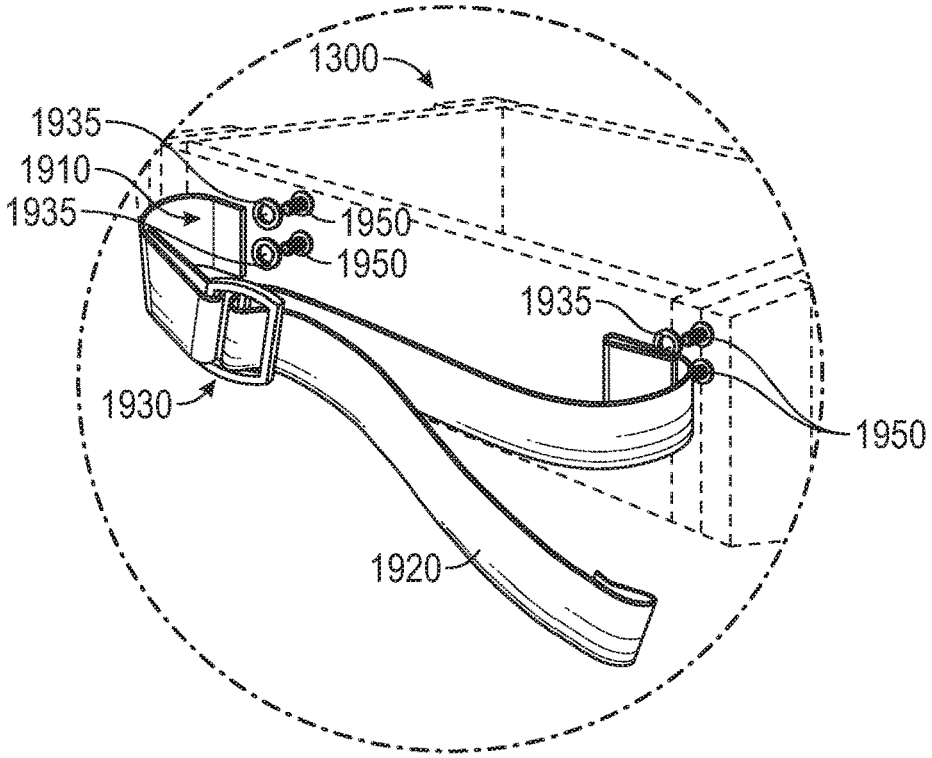
FIG. 19A illustrates a perspective view of an example arrangement of a strap assembly affixed to the example storage bin shown in FIG. 13A, according to one or more embodiments of the disclosure.

FIG. 19A illustrates a perspective view of an example arrangement of a strap assembly affixed to the example storage bin 1330 shown in FIG. 13A, according to one or more embodiments of the disclosure. The strap assembly includes a first strap 1910 and a second strap 1920 coupled to the first strap 1910 visa a buckle 1930. A first end of the first strap 1910 and a first end of the strap 1920 can be affixed to the sidewall 1330. Each one of those first ends can be coupled to the storage bin 1330 via screws 1950 and washers 1935.

Figure 19B:
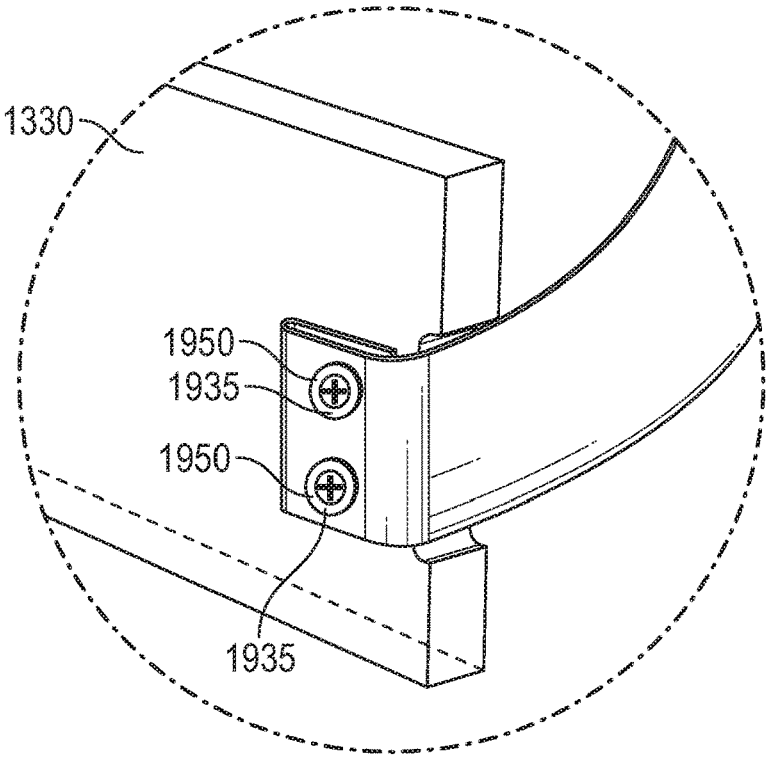
FIG. 19B illustrates a perspective view of an example of attachment structure of the strap assembly shown in FIG. 19A, according to one or more embodiments of the disclosure.

FIG. 19B illustrates a perspective view of an example of attachment structure of the strap assembly shown in FIG. 19A, according to one or more embodiments of the disclosure. An end of either one the strap 1910 or the strap 1920 is attached via screws 1950 to an interior surface of the sidewall 1330.

Other Example Embodiments

Numerous embodiments emerge from the foregoing detailed description and annexed drawings. For instance, an Example 1 of those embodiments includes a seat assembly. The seat assembly includes a seat member having a first seat surface, a second seat surface, and a third seat surface opposite the second seat surface, wherein the third seat surface is essentially parallel to the second seat surface, and wherein the first seat surface is substantially perpendicular to the second seat surface and the third seat surface; a first side panel affixed to the second seat surface, wherein the first side panel is substantially perpendicular to the first seat surface; a second side panel affixed to the third seat surface, wherein the second side panel is substantially perpendicular to the first seat surface; and a bin movably affixed to the first side panel and the second side panel, the bin comprising an open compartment and being movable between a first position that obstructs the compartment and a second position that permits access to the compartment.

An Example 2 of the numerous example embodiments includes seat assembly of Example 1, where each one of the first side panel and the second side panel comprises a perimeter surface comprising, a first area substantially parallel to the first seat surface; and a second area oblique to the first seat surface, the second portion being adjacent the first portion, where a plane substantially perpendicular to the first seat surface contains a first vector normal to the first area and a second vector normal to the second area.

An Example 3 of the numerous example embodiments includes the seat assembly of Example 2, where the first area permits orientation of the seat assembly in a direction substantially parallel to the direction of gravity, and where the second area permits orientation of the seat assembly in a direction oblique to the direction of gravity.

An Example 4 of the numerous example embodiments includes the seat assembly of Example 3, where the first side panel comprises a pedestal that protrudes from a first planar surface substantially perpendicular to the perimeter surface of the first side panel, and where the second side panel comprises a second pedestal that protrudes from a second planar surface substantially perpendicular to the perimeter surface of the second side panel.

An Example 5 of the numerous example embodiments includes the seat assembly of Example 1, where the bin comprises a first bin sidewall and a second bin sidewall opposite the first bin sidewall, where the first bin sidewall defines first openings through the first bin sidewall, the first openings aligned along a direction substantially perpendicular to the first seat surface, and where the second bin sidewall defines second openings through the first bin sidewall, the second openings aligned along the direction substantially perpendicular to the first seat surface.

An Example 6 of the numerous example embodiments includes the seat assembly of Example 5, where the first bin sidewall comprises a first recess that slidably engages the first side panel, the first recess comprising a bottom surface that defines the plurality of first openings, and where the second bin sidewall comprises a second recess that slidably engages the second side panel, the second recess comprising a bottom surface that defines the plurality of second openings.

An Example 7 of the numerous example embodiments includes the seat assembly of Example 6, further comprising a first pin that engages a specific opening of the first openings; and a second pin that engages a specific opening of the second openings, wherein the specific opening of the first openings is opposite to the specific opening of the second openings.

An Example 8 of the numerous example embodiments includes the seat assembly of Example 7, where engaging the specific opening of the first openings and engaging the specific opening of the second openings arrange the bin relative to the first seat surface in the first position.

An Example 9 of the numerous example embodiments includes the seat assembly of Example 7, where engaging the specific opening of the first openings and engaging the specific opening of the multiple second openings arrange the bin relative to the first seat surface in the second position.

An Example 10 of the numerous example embodiments includes the seat assembly of Example 1, further comprising an elastic member having a first end affixed to a first sidewall of the first side panel and a second end affixed to a second sidewall of the first side panel, the second sidewall of the first side panel being opposite to the first sidewall of the first side panel.

An Example 11 of the numerous example embodiments includes the seat assembly of Example 10, where the first side panel comprises a recess that receives the elastic member, the recess extending from an end of the first sidewall of the first side panel to an end of the second sidewall of the first side panel.

An Example 12 of the numerous example embodiments includes the seat assembly of Example 10, further comprising a second elastic member having a first end affixed to a first sidewall of the second side panel and a second end affixed to a second sidewall of the second side panel, the second sidewall of the second side panel being opposite to the first sidewall of the second side panel.

An Example 13 of the numerous example embodiments includes the seat assembly of Example 12, where the second side panel comprises a recess that receives the second elastic member, the recess extending from an end of the first sidewall of the second side panel to an end of the second sidewall of the second side panel.

An Example 14 of the numerous example embodiments includes a method. The method comprises: providing a seat member comprising having a first seat surface, a second seat surface, and a third seat surface opposite the second seat surface, wherein the third seat surface is essentially parallel to the second seat surface, and wherein the first seat surface is substantially perpendicular to the second seat surface and the third seat surface; affixing a first side panel to the second seat surface, wherein the first side panel is affixed substantially perpendicular to the first seat surface; affixing a second side panel to the third seat surface, wherein the second side panel is affixed substantially perpendicular to the first seat surface; and movably affixing a bin to the first side panel and the second side panel, the bin comprising an open compartment and being movable between a first position that obstructs the compartment and a second position that permits access to the compartment.

An Example 15 of the numerous example embodiments includes the method of Example 14, where each one of the first side panel and the second side panel comprises a perimeter surface comprising, a first area substantially parallel to the first seat surface; and a second area oblique to the first seat surface, the second portion being adjacent the first portion, where a plane substantially perpendicular to the first seat surface contains a first vector normal to the first area and a second vector normal to the second area.

An Example 16 of the numerous example embodiments includes the method of Example 14, where the bin comprises a first bin sidewall and a second bin sidewall opposite the first bin sidewall, wherein the first bin sidewall defines first openings through the first bin sidewall, the first openings aligned along a direction substantially perpendicular to the first seat surface, and wherein the second bin sidewall defines second openings through the first bin sidewall, the second openings aligned along the direction substantially perpendicular to the first seat surface.

An Example 17 of the numerous example embodiments includes the method of Example 16, where the first bin sidewall comprises a first recess that slidably engages the first side panel, the first recess comprising a bottom surface that defines the plurality of first openings, and where the second bin sidewall comprises a second recess that slidably engages the second side panel, the second recess comprising a bottom surface that defines the plurality of second openings.

An Example 18 of the numerous example embodiments includes the method of Example 17, further comprising: engaging a first pin into a specific opening of the first openings; and engaging a second pin into a specific opening of the second openings, wherein the specific opening of the first openings is opposite to the specific opening of the second openings, resulting in the bin being arranged relative to the first seat surface in one of the first position or the second position.

An Example 19 of the numerous example embodiments includes the method of Example 14, further comprising affixing an elastic member to the first side panel.

An Example 20 of the numerous example embodiments includes the method of Example 19, where the affixing the elastic member to the first side panel comprises affixing a first end of the elastic member to a first sidewall of the first side panel; and affixing a second end of the elastic member to a second sidewall of the first side panel, the second sidewall of the first side panel being opposite to the first sidewall of the first side panel.

Unique seat assemblies have been disclosed herein. Various changes and substitutions can of course be made without departing from the spirit and scope of the disclosure.

While the disclosure has been illustrated and described as embodied in a seating device, it is not intended to be limited to the details shown since various modifications and structural changes may be made without departing in any way from the spirit of the present disclosure. The embodiments were chosen and described in order to best explain the principles of the disclosure and practical application to thereby enable a person skilled in the art to best utilize the invention and various embodiments with various modifications as are suited to the particular use contemplated.

Definitions

The following definitions are included to provide a clear and consistent understanding of the specification and claims. As used herein, the recited terms have the following meanings. All other terms and phrases used in this specification have their ordinary meanings as one of skill in the art would understand.

References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

The singular forms "a," "an," and "the" include plural reference unless the context clearly dictates otherwise. It is further noted that the claims may be drafted to exclude any optional element. As such, this statement is intended to serve as antecedent basis for the use of exclusive terminology, such as "solely," "only," and the like, in connection with any element described herein, and/or the recitation of claim elements or use of "negative" limitations.

The term "and/or" means any one of the items, any combination of the items, or all of the items with which this term is associated. The phrase "one or more" is readily understood by one of skill in the art, particularly when read in context of its usage.

As used herein, the term "about" refers to a given variation from a given value. It is to be understood that such a variation is always included in any given value provided herein, whether or not it is specifically referred to.

One skilled in the art will also readily recognize that where members are grouped together in a common manner, such as in a Markush group, the disclosure encompasses not only the entire group listed as a whole, but each member of the group individually and all possible subgroups of the main group. Additionally, for all purposes, the disclosure encompasses not only the main group, but also the main group absent one or more of the group members. The disclosure therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, for use in an explicit negative limitation.

As used herein, the term "substantially parallel" indicates that the parallel relationship is not a strict relationship and does not exclude functionally similar variations therefrom. As used herein the term "substantially perpendicular" indicates that the perpendicular relationship between two or more elements of a premanufactured view tile are not a strict relationship and does not exclude functionally similar variations therefrom.

The term "horizontal" as used herein may be defined as a direction parallel to a plane or surface (e.g., surface of a substrate), regardless of its orientation. The term "vertical," as used herein, may refer to a direction orthogonal to the horizontal direction as just described. Terms, such as "on, "above," "below," "bottom," "top," "side" (as in "sidewall"), "higher," "lower," "upper," "over," and "under," may be referenced with respect to the horizontal plane.

What is claimed is:

1. A seat assembly, comprising:

a seat member having a first seat surface, a second seat surface, and a third seat surface opposite the second seat surface, wherein the third seat surface is essentially parallel to the second seat surface, and wherein the first seat surface is substantially perpendicular to the second seat surface and the third seat surface;

a first side panel affixed to the second seat surface, wherein the first side panel is substantially perpendicular to the first seat surface;

a second side panel affixed to the third seat surface, wherein the second side panel is substantially perpendicular to the first seat surface; and a bin movably affixed to the first side panel and the second side panel, the bin comprising an open compartment and being movable between a first position that obstructs the compartment and a second position that permits access to the compartment;

wherein each one of the first side panel and the second sidepanel comprises a perimeter surface comprising, a first area substantially parallel to the first seat surface; and a second area oblique to the first seat surface, the second portion being adjacent the first portion, wherein a plane substantially perpendicular to the first seat surface contains a first vector normal to the first area and a second vector normal to the second area.

2. The seat assembly of claim 1, wherein the first area permits orientation of the seat assembly in a direction substantially parallel to the direction of gravity, and wherein the second area permits orientation of the seat assembly in a direction oblique to the direction of gravity.

3. The seat assembly of claim 2, wherein the first side panel comprises a pedestal that protrudes from a first planar surface substantially perpendicular to the perimeter surface of the first side panel, and wherein the second side panel comprises a second pedestal that protrudes from a second planar surface substantially perpendicular to the perimeter surface of the second side panel.

4. The seat assembly of claim 1, further comprising an elastic member having a first end affixed to a first sidewall of the first side panel and a second end affixed to a second sidewall of the first side panel, the second sidewall of the first side panel being opposite to the first sidewall of the first side panel.

5. The seat assembly of claim 4, wherein the first side panel comprises a recess that receives the elastic member, the recess extending from an end of the first sidewall of the first side panel to an end of the second sidewall of the first side panel.

6. The seat assembly of claim 4, further comprising a second elastic member having a first end affixed to a first sidewall of the second side panel and a second end affixed to a second sidewall of the second side panel, the second sidewall of the second side panel being opposite to the first sidewall of the second side panel.

7. The seat assembly of claim 6, wherein the second side panel comprises a recess that receives the second elastic member, the recess extending from an end of the first sidewall of the second side panel to an end of the second sidewall of the second side panel.

8. A method, comprising:

providing a seat member comprising having a first seat surface, a second seat surface, and a third seat surface opposite the second seat surface, wherein the third seat surface is essentially parallel to the second seat surface, and wherein the first seat surface is substantially perpendicular to the second seat surface and the third seat surface;

affixing a first side panel to the second seat surface, wherein the first side panel is affixed substantially perpendicular to the first seat surface;

affixing a second side panel to the third seat surface, wherein the second side panel is affixed substantially perpendicular to the first seat surface; and movably affixing a bin to the first side panel and the second side panel, the bin comprising an open compartment and being movable between a first position that obstructs the compartment and a second position that permits access to the compartment, wherein each one of the first side panel and the second side panelcomprises a perimeter surface comprising, a first area substantially parallel to the first seat surface; and a second area oblique to the first seat surface, the second portion being adjacent the first portion, wherein a plane substantially perpendicular to the first seat surface contains a first vector normal to the first area and a second vector normal to the second area.

9. The method of claim 8, wherein the bin comprises a first bin sidewall and a second bin sidewall opposite the first bin sidewall, wherein the first bin sidewall defines first openings through the first bin sidewall, the first openings aligned along a direction substantially perpendicular to the first seat surface, and wherein the second bin sidewall defines second openings through the first bin sidewall, the second openings aligned along the direction substantially perpendicular to the first seat surface.

10. The method of claim 9, wherein the first bin sidewall comprises a first recess that slidably engages the first side panel, the first recess comprising a bottom surface that defines the plurality of first openings, and wherein the second bin sidewall comprises a second recess that slidably engages the second side panel, the second recess comprising a bottom surface that defines the plurality of second openings.

11. The method of claim 10, further comprising, engaging a first pin into a specific opening of the first openings; and engaging a second pin into a specific opening of the second openings, wherein the specific opening of the first openings is opposite to the specific opening of the second openings, resulting in the bin being arranged relative to the first seat surface in one of the first position or the second position.

12. The method of claim 8, further comprising affixing an elastic member to the first side panel.

13. The method of claim 12, wherein the affixing the elastic member to the first side panel comprises, affixing a first end of the elastic member to a first sidewall of the first side panel; and affixing a second end of the elastic member to a second sidewall of the first side panel, the second sidewall of the first side panel being opposite to the first sidewall of the firstside panel.

14. A seat assembly, comprising:

a seat member having a first seat surface, a second seat surface, and a third seat surface opposite the second seat surface, wherein the third seat surface is essentially parallel to the second seat surface, and wherein the first seat surface is substantially perpendicular to the second seat surface and the third seat surface;

a first side panel affixed to the second seat surface, wherein the first side panel Is substantially perpendicular to the first seat surface;

a second side panel affixed to the third seat surface, wherein the second side panel is substantially perpendicular to the first seat surface; and a bin movably affixed to the first side panel and the second side panel, the bin comprising an open compartment and being movable between a first position that obstructs the compartment and a second position that permits access to the compartment;

wherein the bin comprises a first bin sidewall and a second bin sidewall opposite the first bin sidewall, wherein the first bin sidewall defines first openings through the first bin sidewall, the first openings aligned along a direction substantially perpendicular to the first seat surface, and wherein the second bin sidewall defines second openings through the first bin sidewall, the second openings aligned along the direction substantially perpendicular to the first seat surface.

15. The seat assembly of claim 14, wherein the first bin sidewall comprises a first recess that slidably engages the first side panel, the first recess comprising a bottom surface that defines the plurality of first openings, and wherein the second bin sidewall comprises a second recess that slidably engages the second side panel, the second recess comprising a bottom surface that defines the plurality of second openings.

16. The seat assembly of claim 15, further comprising, a first pin that engages a specific opening of the first openings; and a second pin that engages a specific opening of the second openings, wherein the specific opening of the first openings is opposite to the specific opening of the second openings.

17. The seat assembly of claim 16, wherein engaging the specific opening of the first openings and engaging the specific opening of the second openings arrange the bin relative to the first seat surface in the first position.

18. The seat assembly of claim 16, wherein engaging the specific opening of the first openings and engaging the specific opening of the second openings arrange the bin relative to the first seat surface in the second position.

* * * * *